US012259221B2

(12) United States Patent
Olson et al.

(10) Patent No.: US 12,259,221 B2
(45) **Date of Patent: *Mar. 25, 2025**

(54) QUICK RELEASE FOR BALLISTIC SHIELD

(71) Applicant: Bunker Supply Co., LLC, Goleta, CA (US)

(72) Inventors: Ryan Olson, Goleta, CA (US); Jared Naito, Santa Barbara, CA (US); Marco Vanella, Goleta, CA (US)

(73) Assignee: Bunker Supply Co., LLC, Goleta, CA (US)

( * ) Notice: Subject to any disclaimer, the term of this patent is extended or adjusted under 35 U.S.C. 154(b) by 79 days.

This patent is subject to a terminal disclaimer.

(21) Appl. No.: 18/457,084

(22) Filed: Aug. 28, 2023

(65) Prior Publication Data

US 2023/0408227 A1 Dec. 21, 2023

Related U.S. Application Data

(63) Continuation-in-part of application No. 18/168,140, filed on Feb. 13, 2023, now abandoned, which is a continuation of application No. 17/859,948, filed on Jul. 7, 2022, now Pat. No. 11,578,949.

(60) Provisional application No. 63/223,884, filed on Jul. 20, 2021.

(51) Int. Cl.
*F41H 5/013* (2006.01)
*F41H 1/02* (2006.01)

(52) U.S. Cl.
CPC ..... *F41H 5/013* (2013.01); *F41H 1/02* (2013.01)

(58) Field of Classification Search
CPC ..... F41H 1/02; F41H 5/013
See application file for complete search history.

(56) References Cited

U.S. PATENT DOCUMENTS 5,060,314 A * 10/1991 Lewis ..... A62B 17/003 2/2.5
6,769,137 B2 * 8/2004 D'Annunzio ..... F41H 1/02 2/102
7,424,748 B1 * 9/2008 McDunn ..... F41H 1/02 2/2.5

(Continued)

OTHER PUBLICATIONS

HighCom Armor Solutions, Inc., The Guardian GSS (Rifle Insert Spall Sleeve), product brochure, Doc. Control: 200728.01.KG-VER 12.0 Approved Aug. 2, 2021.

*Primary Examiner* — Joshua E Freeman
(74) *Attorney, Agent, or Firm* — SoCal IP Law Group LLP; Guy L. Cumberbatch; Steven C. Sereboff

(57) ABSTRACT

A quick-release ballistic plate assembly for a protective vest includes an outer chassis configured to attach to a chest and/or back panel of the vest. The outer chassis has an open lower end leading to an inner cavity, wherein a ballistic plate and sleeve subassembly inserts upward into the cavity. An emergency release handle depending downward from the subassembly may be pulled to overcome a retention mechanism and jettison the subassembly in case the wearer ends up in a body of water or alternative situation requiring such function. This avoids the need to shed the entire protective vest which typically has numerous pockets for a variety of tools, survival gear and ammunition. The assembly may be built into the protective vest at the OEM level, or may be retrofit to existing vests.

23 Claims, 19 Drawing Sheets

(56) References Cited

U.S. PATENT DOCUMENTS 7,979,917 B2 * 7/2011 Osborne ..... F41H 1/02 2/2.5
9,222,757 B2 12/2015 Seuk
9,949,514 B2 * 4/2018 Gill ..... A41F 1/00
10,845,163 B2 11/2020 Nardone
2005/0005342 A1 * 1/2005 Johnson ..... F41H 1/02 2/102
2005/0005343 A1 * 1/2005 Johnson ..... F41H 1/02 2/102
2008/0263737 A1 * 10/2008 Parks ..... F41H 1/02 2/2.5
2009/0282595 A1 * 11/2009 Branson ..... F41H 1/02 2/2.5
2010/0025560 A1 * 2/2010 Beck ..... A45F 5/02 248/558
2010/0205708 A1 * 8/2010 Storms, Jr. ..... A41D 13/05 2/2.5
2010/0223705 A1 * 9/2010 Osborne ..... F41H 1/02 2/2.5
2010/0287681 A1 * 11/2010 Storms, Jr. ..... F41H 1/02 2/102
2011/0094006 A1 * 4/2011 Cole ..... F41H 1/02 2/102
2012/0132065 A1 * 5/2012 Seuk ..... F41H 1/02 89/36.05
2012/0167267 A1 * 7/2012 Osman ..... F41H 1/02 2/2.5
2012/0174286 A1 * 7/2012 McBride ..... F41H 1/02 2/102
2012/0174764 A1 7/2012 Medwell
2012/0180178 A1 * 7/2012 Gallo ..... F41H 1/02 2/2.5
2016/0138894 A1 5/2016 Jeise
2020/0333111 A1 * 10/2020 Ward ..... F41H 1/02

* cited by examiner

QUICK RELEASE FOR BALLISTIC SHIELD

RELATED APPLICATIONS

The present application is a continuation-in-part of U.S. patent application Ser. No. 18/168,140, filed Feb. 13, 2023, which is a continuation of U.S. patent application Ser. No. 17/859,948, filed Jul. 7, 2022, now U.S. Pat. No. 11,578,949, which claims priority to U.S. Provisional Application No. 63/223,884, filed Jul. 20, 2021, all of which are incorporated herein by reference.

GOVERNMENT INTERESTS

This invention was made with Government support under N68335-21-C-0485 awarded by the Department of the Navy. The Government has certain rights in the invention.

BACKGROUND

Field

This disclosure relates to a universal insert compatible across protective vest platforms and a retrofit kit that is specific to a vest platform enabling quick release for a ballistic shield within the vest.

Description of the Related Art

A ballistic vest or bullet-resistant vest, often called a bulletproof vest or plate carrier, is an item of personal armor worn on the torso that helps absorb the impact and reduce or stop penetration to the body from firearm-fired projectiles. Soft armor vests are made of many layers of woven or laminated fibers and can protect the wearer from small-caliber handgun and shotgun projectiles. These vests often have a ballistic plate inserted into the vest. Metal or ceramic plates can be used with a soft vest, providing additional protection against rifle rounds.

Hard-plate reinforced vests are mainly worn by combat soldiers, police tactical units, and hostage rescue teams but are becoming increasingly popular also among civilian users. Hard-plate reinforced vests may include an exterior pocket that is sized to accommodate the hard plate and that protrudes from an outer face of the vest. The pocket may be closed with stitching. If the wearer of the vest ends up in a body of water, the heavy ballistic plate(s) presents a serious buoyancy issue, requiring the wearer to immediately discard the vest or risk drowning. A major drawback with such an emergency decision is that the vest typically has numerous pockets for a variety of tools, survival gear and ammunition, so that jettisoning the vest saves the wearer's life but at a high cost.

There is thus a need for an improved protective vest.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

A quick-release ballistic plate assembly for a protective vest includes an outer chassis configured to attach to a chest panel and/or back panel of the vest is disclosed. The outer chassis has an open lower end leading to an inner cavity, wherein a ballistic plate and sleeve subassembly inserts upward into the cavity. An emergency release handle depending downward from the subassembly may be pulled to overcome a retention mechanism and jettison the subassembly in case the wearer ends up in a body of water. This avoids the need to shed the entire protective vest which typically has numerous pockets for a variety of tools, survival gear and ammunition. The assembly may be built into the protective vest at the OEM level, or may be retrofit to existing vests.

A quick-release ballistic plate assembly for a protective vest, comprising an outer chassis having at least a pair of flexible panels connected together at outer top and side edges thereof, with aligned lower edges unconnected to define a lower mouth leading upward to an inner cavity between the panels, the outer chassis having attachment structure thereon for mounting to the protective vest. A ballistic plate and sleeve subassembly has a rigid ballistic plate held within a flat sleeve made of woven or non-woven fabric such as a low friction polymer, and the subassembly is sized to fit through the open mouth of the outer chassis into the cavity. The subassembly has an emergency release handle at a lower end thereof. A subassembly retention mechanism has a release cable fixed to the emergency release handle that passes laterally outward through a plurality of retention loops, which could be fabric, at or near lower edges of the outer chassis, such as hanging down from the aligned lower edges or inset somewhat to raise the subassembly within the vest. Opposite lateral ends of the release cable are affixed to the outer chassis by safety ties or other retention device such as snaps having sufficient strength to retain the release cable in place against a weight of the subassembly while being configured to break from manual downward pulling on the emergency release handle.

Further advantages, features and details of the invention will be apparent from the following description, in which examples of embodiments of the invention are described in detail with reference to the drawings. In this context, the features mentioned in the claims and in the description may each be essential to the invention individually or in any combination.

Figure 1B:
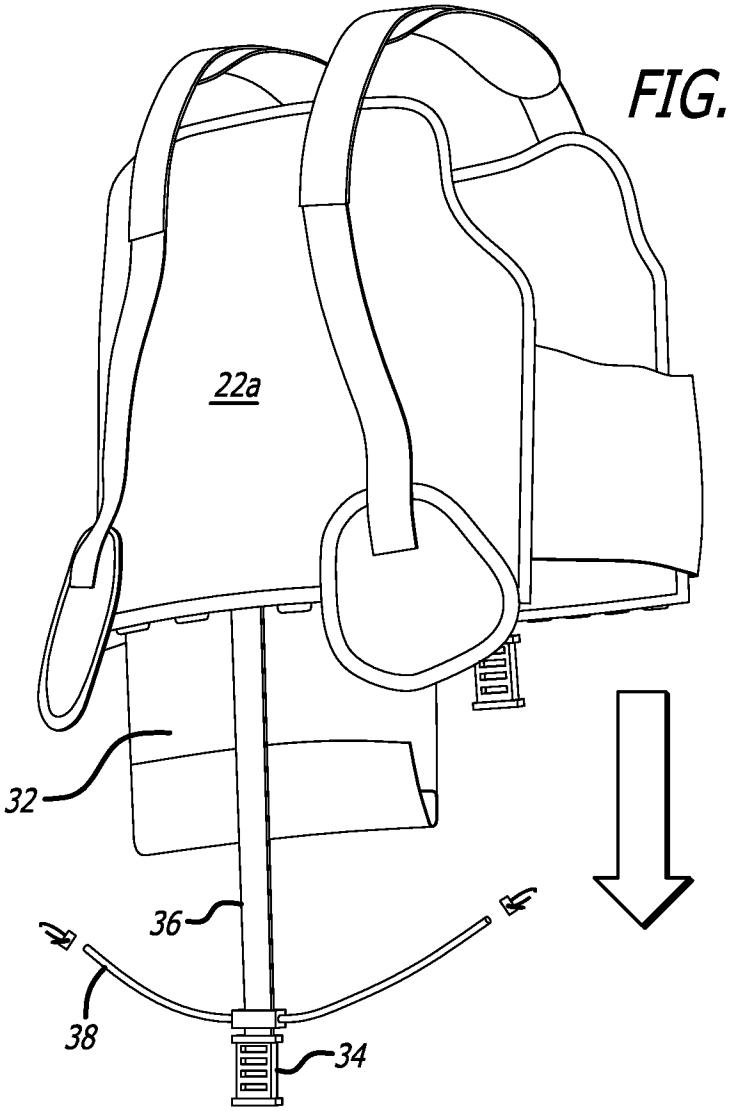
FIG. 1B shows a ballistic plate and sleeve subassembly being separated from the vest.
Figure 1A:
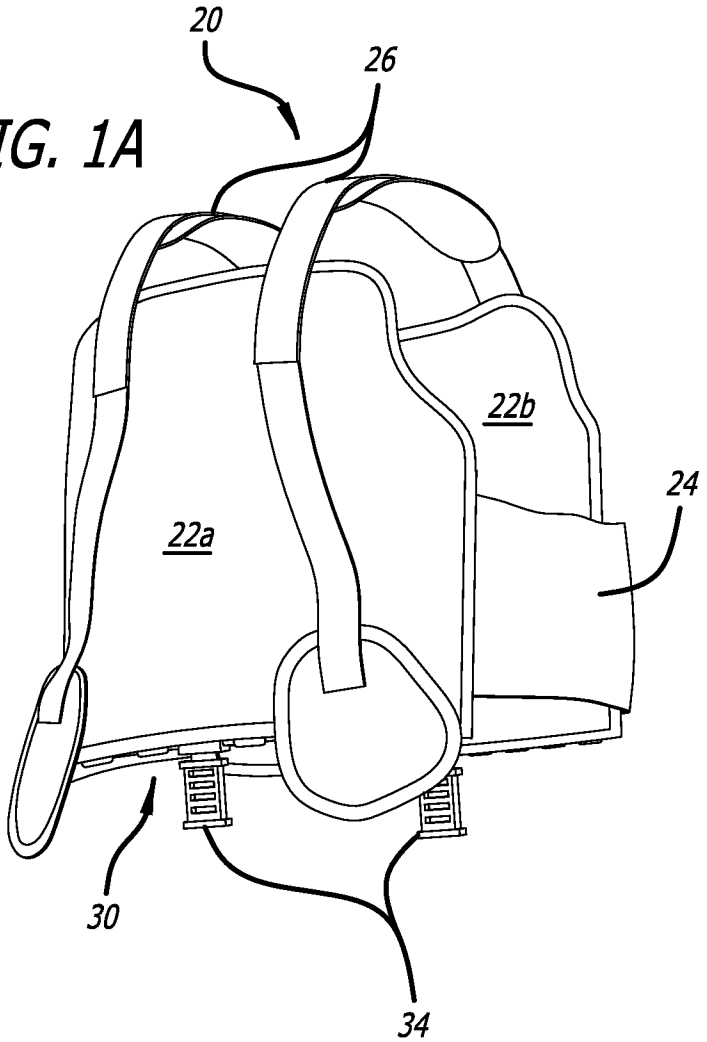
FIG. 1A is a perspective view of a protective vest outfitted with a quick-release ballistic plate assembly.

FIG. 1A is a perspective view of a protective vest 20 outfitted with a quick-release ballistic plate assembly of the present application. The protective vest 20 is representative of a number of similar vests, and includes front chest and rear back panels 22*a*, 22*b* connected via side belts 24, and having a pair of shoulder straps 26 attached to outer faces and looping over the top of both panels. Although not shown, typical protective vests 20 of this nature feature a plurality of loops or pockets for containing ammunition, survival gear, or the like. This type of vest is often known in the industry as CMU-37 or CMU-38.

FIG. 1A shows, at the bottom end of both panels 22*a*, 22*b*, a lower end of a quick-release ballistic plate assembly 30. FIG. 1B shows a ballistic plate and sleeve subassembly 32 being separated from the vest 20. The assembly 30 includes an emergency release handle 34 at the lower end of a pull strap 36 attached (e.g., sewn) to the exterior of the plate and sleeve subassembly 32. Pulling down on the emergency release handle 34 rapidly releases the subassembly 32 which, by virtue of its weight and slight manual pull assistance, drops straight down, thus separating it from the vest 20. Pulling down on the release handle 34 pulls free a release cable 38 that retains the plate and sleeve subassembly 32 within the vest 20.

Figure 3:
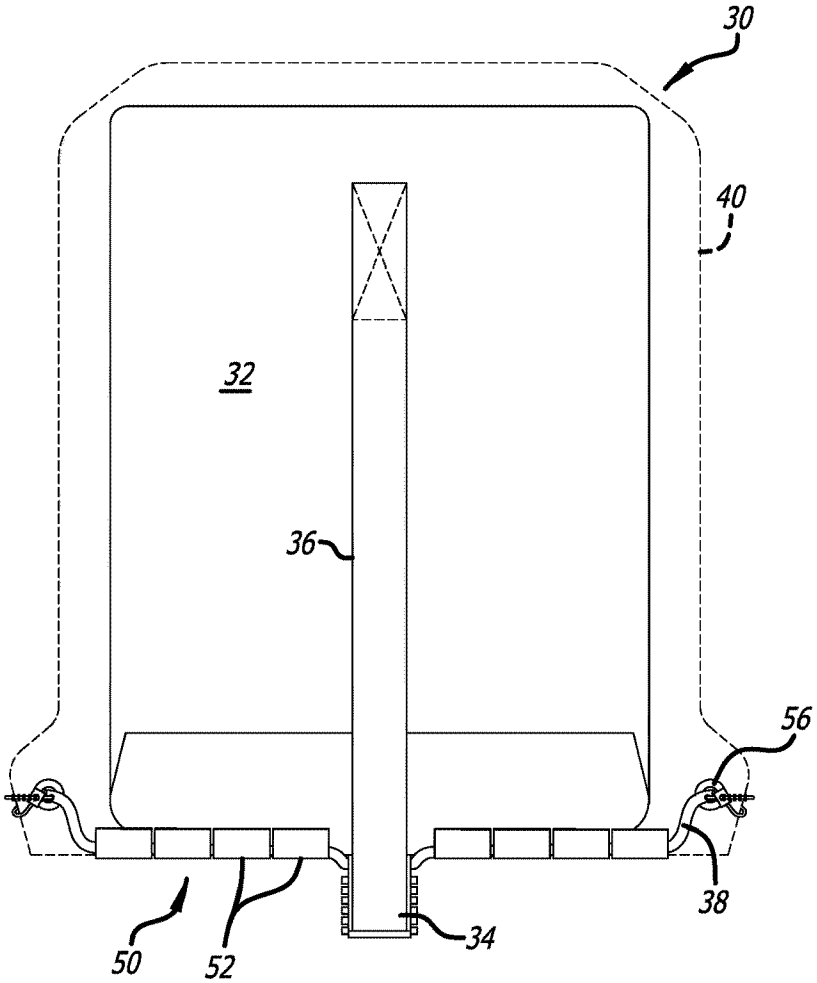
FIG. 3 is a similar view with an outer chassis shown in phantom to visualize an inner ballistic plate and sleeve subassembly.
Figure 2:
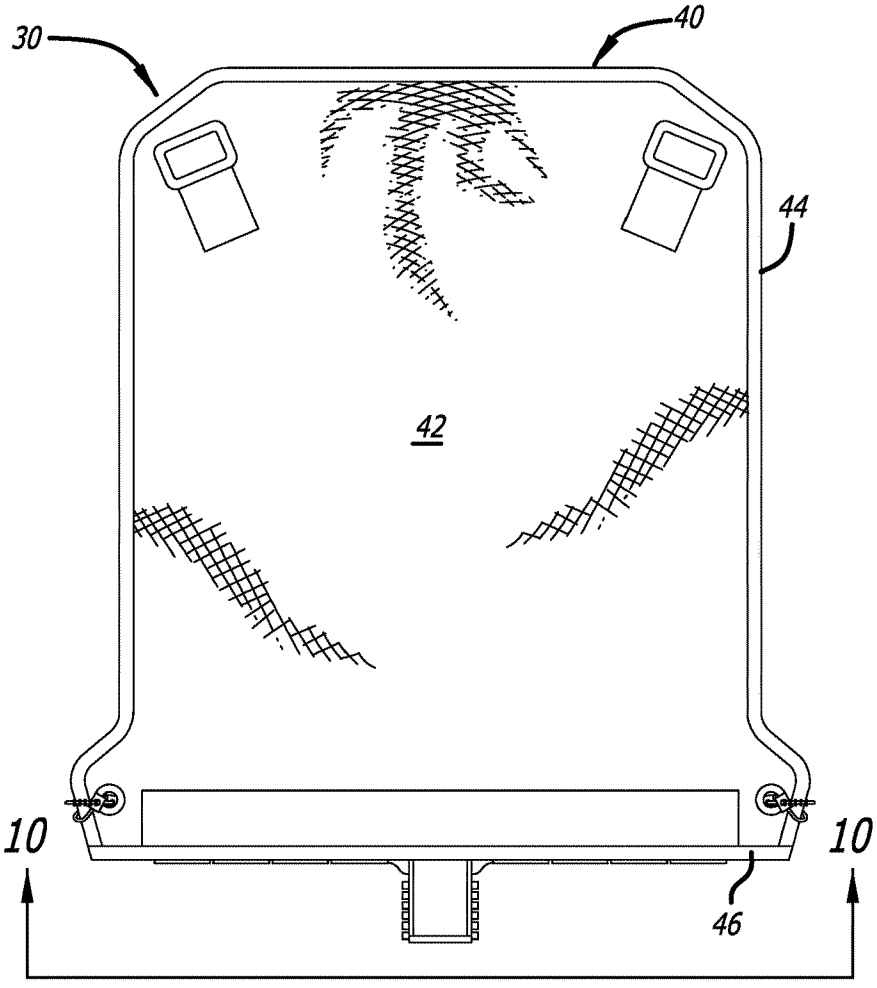
FIG. 2 is an elevational view of the quick-release ballistic plate assembly.

FIG. 2 is an elevational view of the quick-release ballistic plate assembly 30, and FIG. 3 is a similar view with an outer chassis 40 shown in phantom to visualize the inner ballistic plate and sleeve subassembly 32. The outer chassis 40 comprises a generally rectangular flat unit formed of front and rear flexible (e.g., fabric) panels 42 connected together at their top and side edges 44. The bottom edges 46 of the panels 42 are left unconnected so as to form an open lower mouth therebetween that leads upward into a cavity between the panels. The outer chassis 40 may be made of panels of 1000D water repellent, flame-retardant nylon (MIL-DTL-32439 Type I, Class 4), which is a tough, pliable material used extensively in aircrew vests and other flight gear, and is a proven petroleum, oil, lubricant (POL) and flame-resistant material suitable for naval aviation use. The outer chassis 40 is secured within the internal pocket defined between the panels 22*a*, 22*b*, which pocket opens downward.

After the plate and sleeve subassembly 32 is placed within the inner cavity of the outer chassis 40 through the lower mouth, a retention mechanism 50 described below supports the weight of the subassembly 32 from falling out. The emergency release handle 34 projects downward below the lower edges 46 for easy grasping.

FIG. 3 shows the retention mechanism 50 which includes the aforementioned release cable 38 fixedly attached to the emergency release handle 34 or pull strap 36, and FIGS. 4A-4F are perspective views of a lower end of the outer chassis 40 illustrating a retention mechanism. Pull strap 36 is affixed to the plate sleeve via stitching, adhesive, or other method. The release cable 38 extends laterally outward in both directions from the central release handle 34 and passes through a series of retention loops 52 attached at or near the lower edges 46 of the chassis panels 42. The retention loops 52 may be at lower edges of the outer chassis 40 as shown, or inset somewhat into the internal pocket to raise the subassembly 32 within the vest 20.

The release cable 38 is then secured at its outer ends to the chassis 40. More specifically, the release cable 38 has a loop, eyelet or hole 39 (see FIG. 4D) at each outer end through which zip- or safety-ties 54 or an alternative retention device (e.g., snaps) pass. Safety ties 54, in turn, loop through eyelets 56 extending through both panels 42 of the chassis 40.

The safety ties 54 may be configured similar to zip ties, with a ratchet-type tightening mechanism. The safety ties 54 or other retention device are configured to have a nominal strength which retains the release cable 38 in the position illustrated in FIG. 3, but which is relatively easy to break upon yanking the emergency release handle 34 downward. More particularly, the safety ties 54 have sufficient strength to retain the release cable 38 in place against a weight of the subassembly 32 while being configured to break from manual downward pulling on the emergency release handle 34. Reference is made to FIG. 1B showing the plate and sleeve subassembly 32 falling out of the chassis 40 (fastened to the inside of front chest panel 22*a* in the internal pocket defined between the panels 22*a*, 22*b*).

FIGS. 4A-4F are perspective views of a lower end of the outer chassis 40 illustrating several steps in assembling the inner ballistic plate and sleeve subassembly 32 therewith. The outer chassis 40 is shown inserted into an interior pocket formed by the chest panels 22*a*, 22*b* of the protective vest 20, such as seen below where the chassis 40 is attached to an inner wall of a chest panel 22*a*, 22*b*.

Figure 4A:
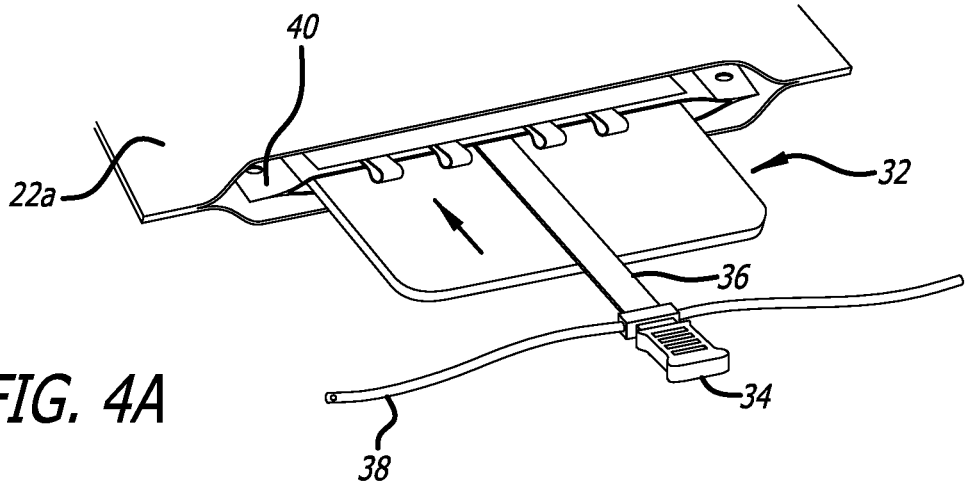
FIGS. 4A-4F are perspective views of a lower end of the outer chassis of the quick-release ballistic plate assembly illustrating several steps in assembling the sleeve subassembly within the chassis.
Figure 4B:
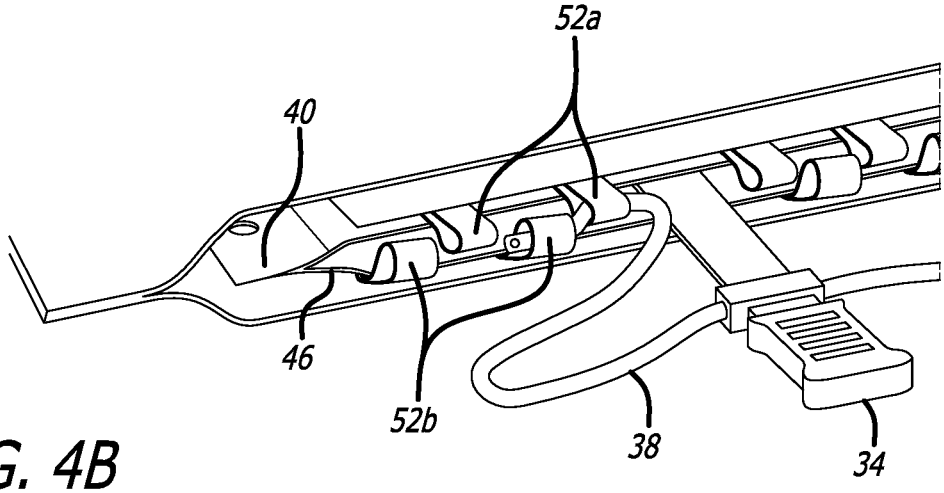

In a first step of assembly, in FIG. 4A, the plate and sleeve subassembly 32 is inserted within the inner cavity of the chassis 40. With the subassembly 32 mostly inserted, the assembler threads the release cable 38 sequentially outward through the retention loops 52*a*, 52*b* on both sides of the release handle 34, as in FIG. 4B. The retention loops 52*a*, 52*b* on the opposite lower edges 46 of the chassis 40 are interlaced such that the release cable 38 passes through loops on alternating edges until it is in the position shown in FIG. 4C. The retention loops 52*a*, 52*b* may be a flexible fabric or constructed of more rigid material such as plastic.

Figure 4C:
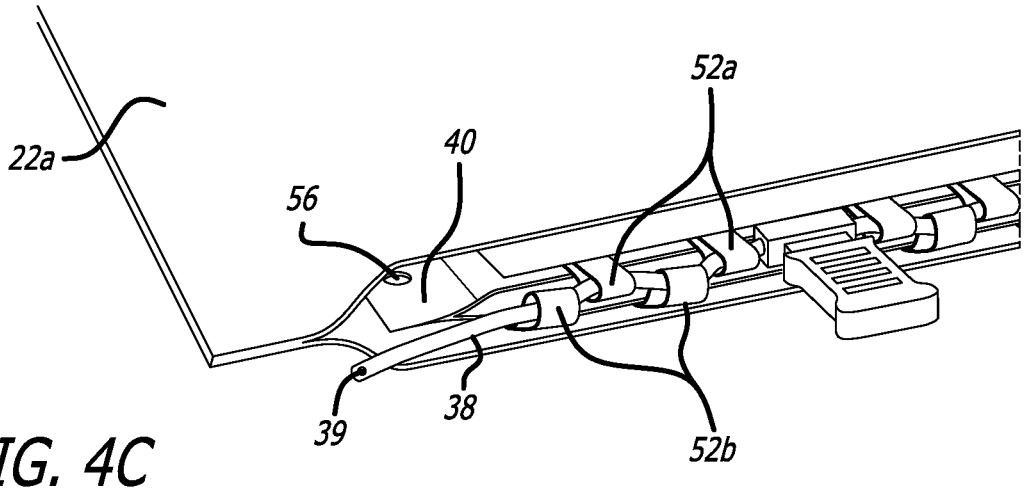
Figure 4D:
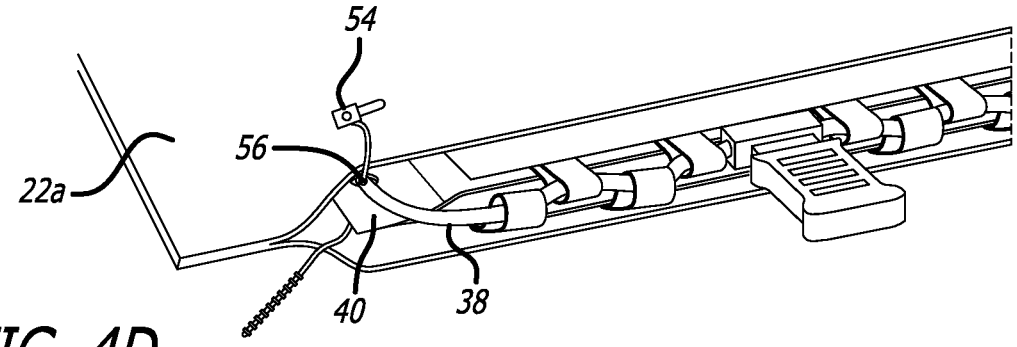
Figure 4E:
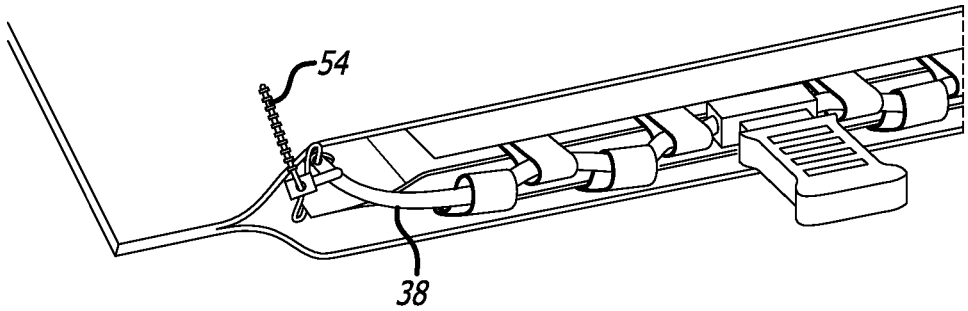
Figure 4F:
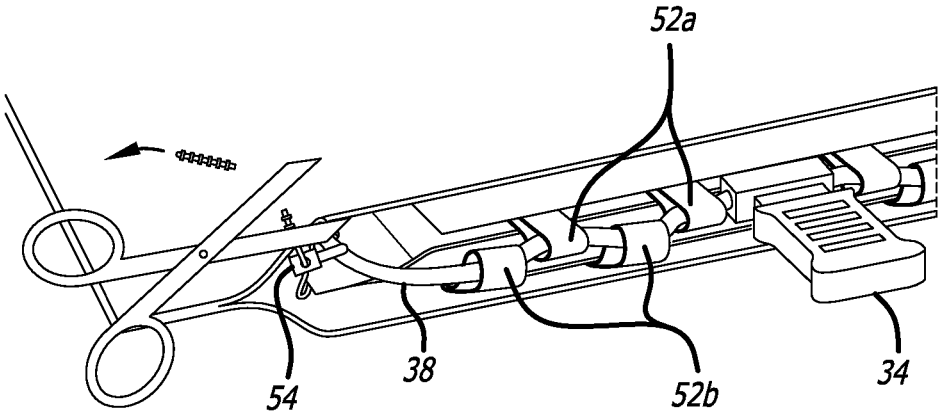

With reference to FIGS. 4C and 4D, a safety tie 54 is then inserted through the loop, eyelet or hole 39 at the end of the release cable 38, and through the eyelet 56 at the lower corner of the chassis 40. Once the safety tie 54 has been closed, as in FIG. 4E, the plate sleeve subassembly 32 is secured within the chassis 40. FIG. 4F shows an optional step of trimming the free end of the safety tie 54. The safety tie 54 provides one breakable anchor which has sufficient strength to retain the release cable 38 in place while being configured to break from manual pulling on the emergency release handle 34.

Figure 5A:
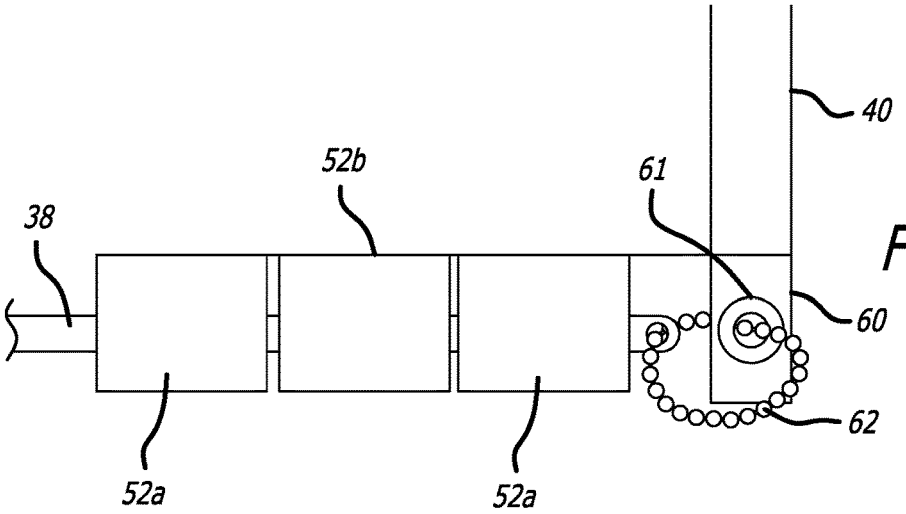
FIGS. 5A-5G are schematic views of several alternative retention devices for securing a release cable to the outer chassis of the quick-release ballistic plate assembly.
Figure 5B:
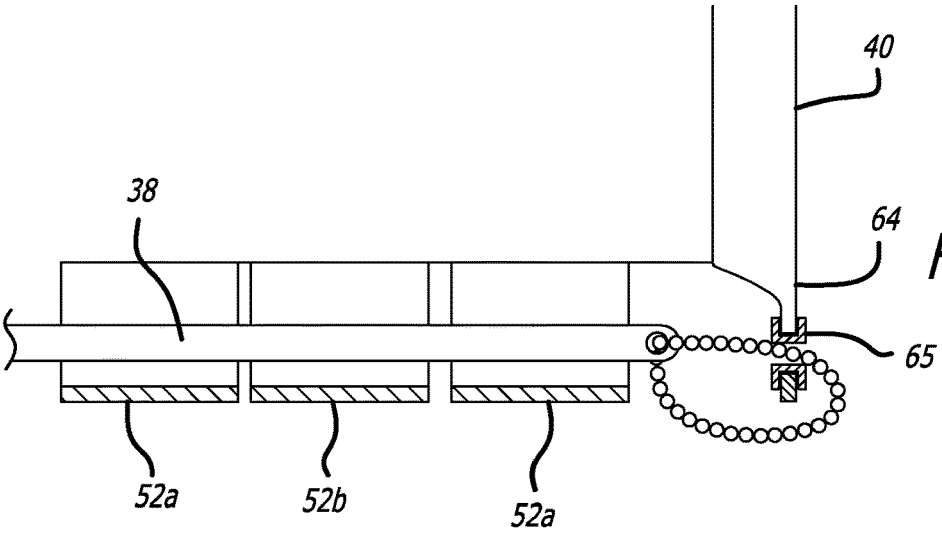

FIGS. 5A-5G are schematic views of several alternative retention devices or breakable anchors for securing the release cable 38 to the outer chassis 40 of the quick-release ballistic plate assembly. In FIG. 5A there will be a semi-rigid strip 60 on the edge of the chassis 40 with a grommet 61 that will break a zip tie or beaded cable 62 when the cable is pulled. In FIG. 5B the side webbing 64 of the chassis 40 will be folded to allow for the installation of a grommet 65 in a perpendicular orientation to the cable 38.

Figure 5C:
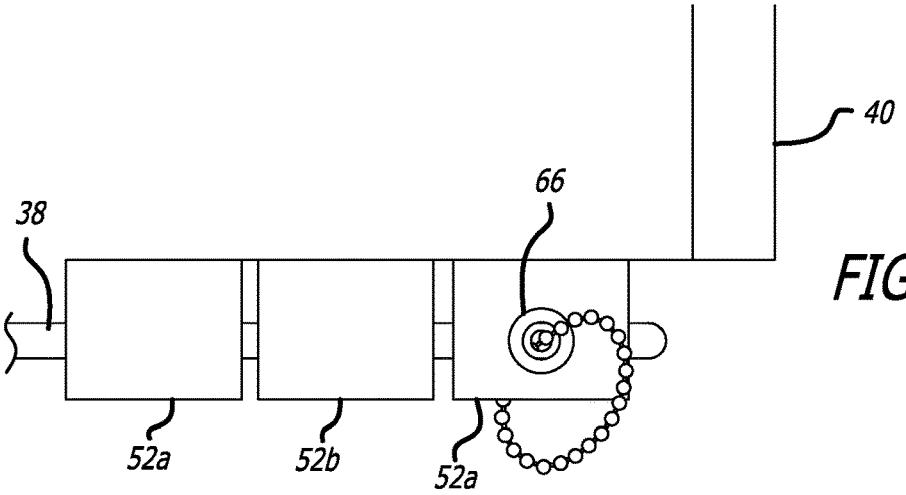
Figure 5D:
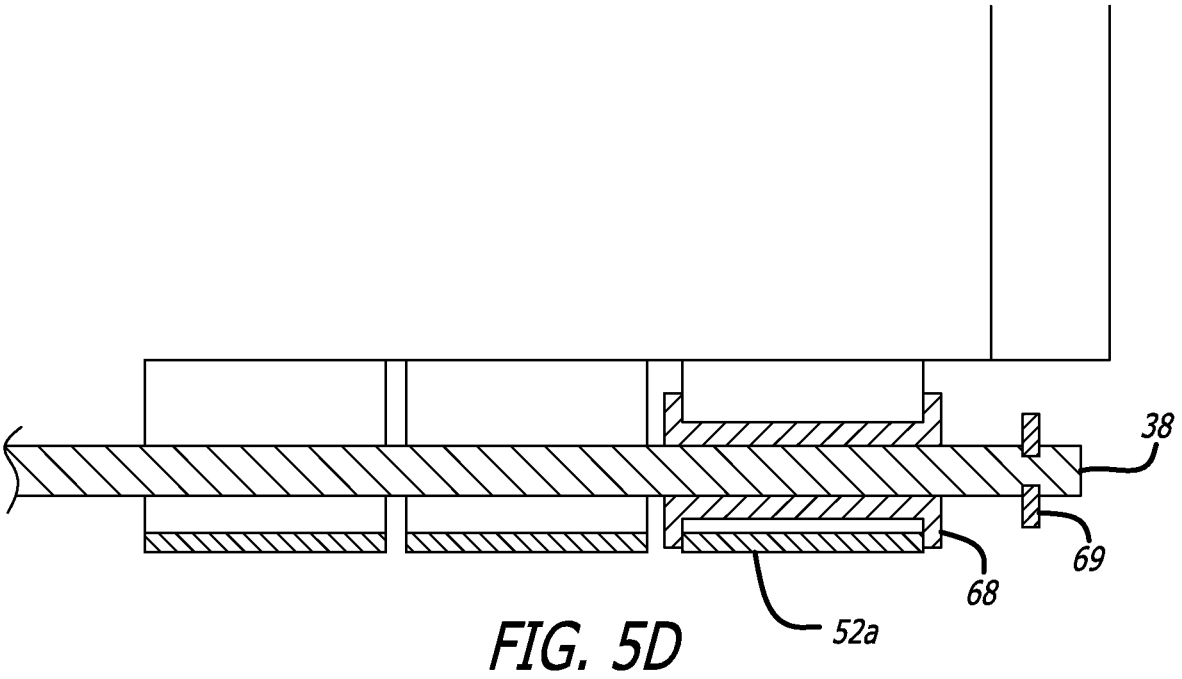
Figure 5E:
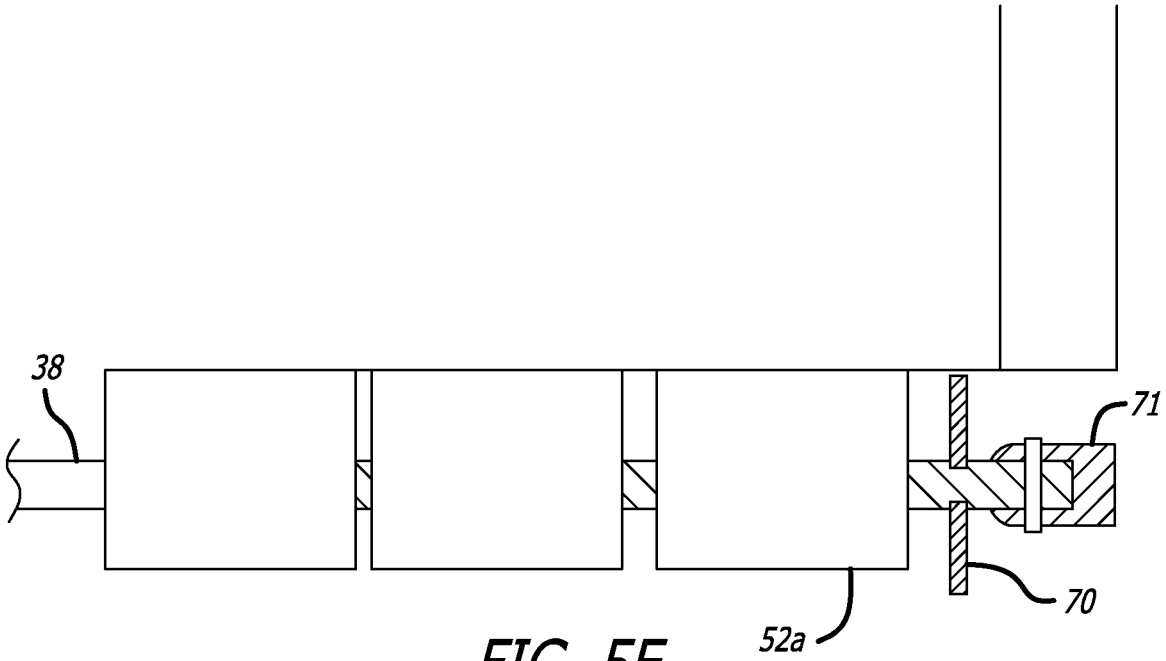

FIG. 5C shows a grommet 66 that is incorporated into outer ones of the mechanism loops 52*a* in order to reduce the length of the cable 38. Since the mechanism loops 52*a*, 52*b* are secured to the chassis 40, the plate sleeve subassembly 32 is held within the chassis until the cable 38 is removed from the loops. FIG. 5D shows an outer loop 52*a* of the retention mechanism having a molded part 68 with a throughbore that fits closely around the cable 38. At the end of the cable 38, a C-clip 69 is positioned. When the cable 38 is pulled, the C-clip 69 will hit the molded part 68 and break or detach to allow the cable to continue opening the mechanism. In FIG. 5E, the cable 38 has a large C-clip 70, and at the very end, a cone 71 with a smaller diameter than the mechanism loop (the cone will be permanently installed). When the cable is pulled, the C-clip will hit the mechanism loop, and the cone will open the C-clip.

Figure 5F:
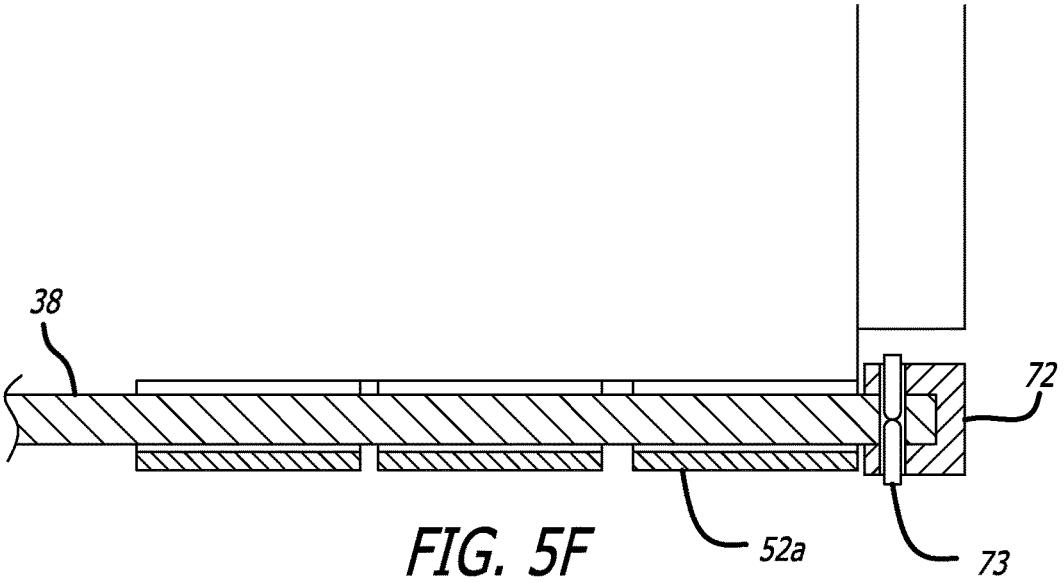
Figure 5G:
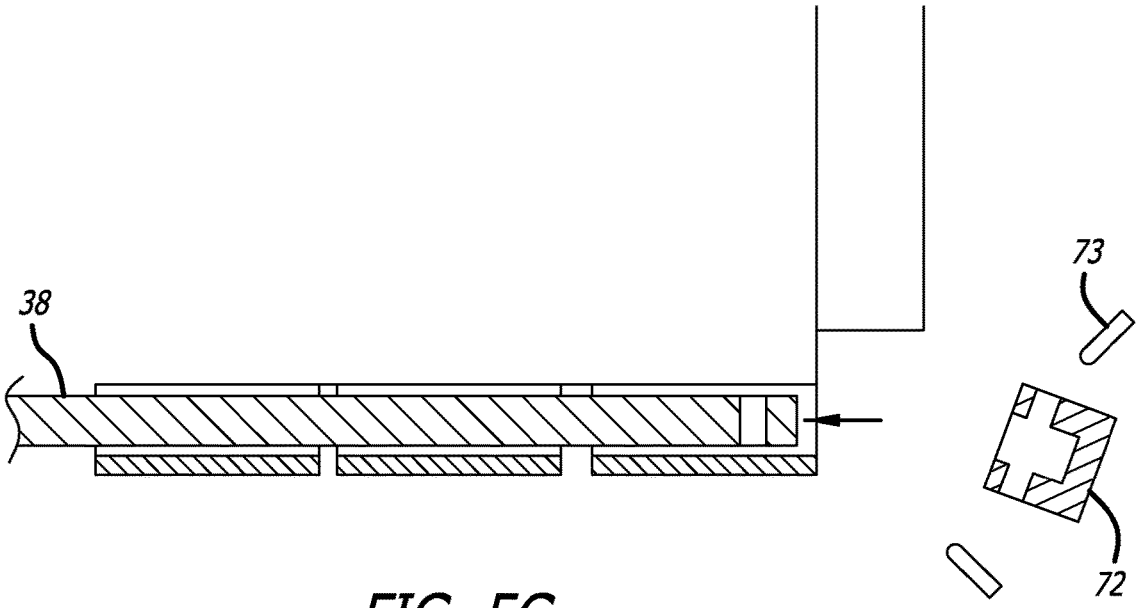

FIGS. 5F and 5G show an arrangement where the cable 38 has a stopper 72 at both ends retained with a pin 73. The pin 73 will have a slimmer section in the middle that will break when the stopper 72 hits the mechanism loop, allowing the cable to keep moving. The loops 52*a* are made smaller in this version so that the stopper 72 cannot pass through.

For the sake of avoiding inadvertent release of the plate and sleeve subassembly 32, the aforementioned breakable anchors are desirable. However, the cable 38 has a relatively stable position when passed through the retention loops 52*a*, 52*b*, and a breakable anchor may not be included. That is, friction enhanced by the weight of the subassembly 32 may be sufficient to retain the cable 38 within the retention loops 52*a*, 52*b* under normal jostling or handling conditions until the emergency release handle 34 is pulled.

Figure 6:
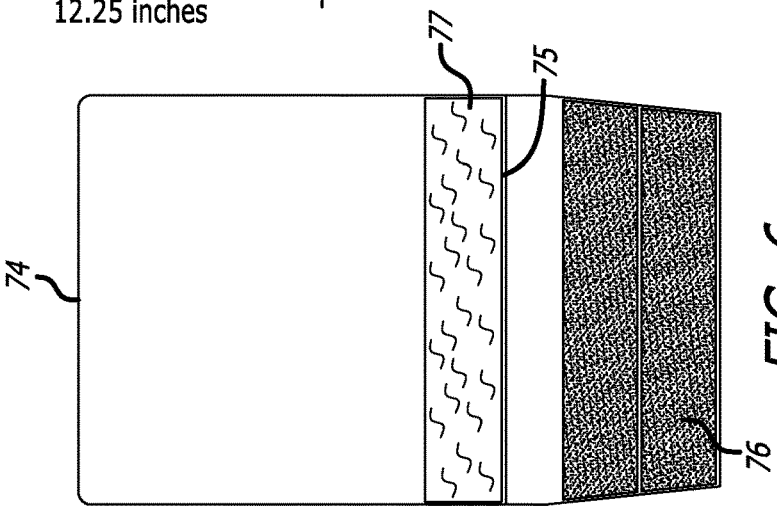
FIG. 6 is an elevational view of a ballistic plate sleeve having a lower end opened up.

FIG. 6 is an elevational view of a ballistic plate sleeve 74 having a lower end 75 opened up. The plate sleeve 74 has an enlarged loose closure flap 84 with one component of a hook and loop fastening patch thereon which meets with the other component in the form of a strip 77 on the exterior of the sleeve. The closure flap 76 has a larger longitudinal dimension than the strip 77 so that the flap may mate with the strip in a variety of positions. This arrangement enables the closure flap 76 to fasten in a variety of configurations in order to conform to different sizes of rigid ballistic plate.

Figure 9A:
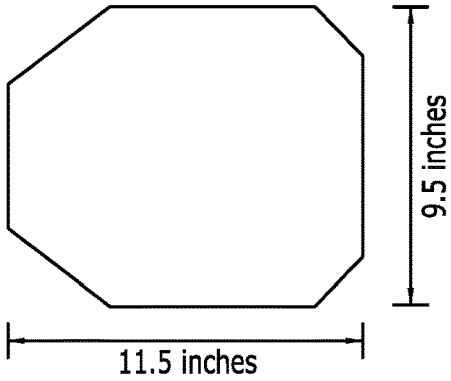
Figure 9B:
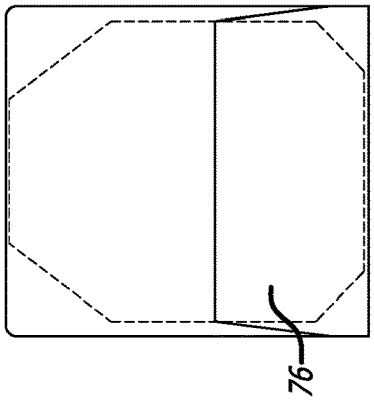
Figure 8A:
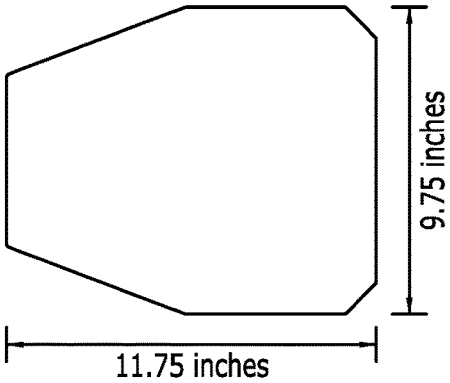
Figure 8B:
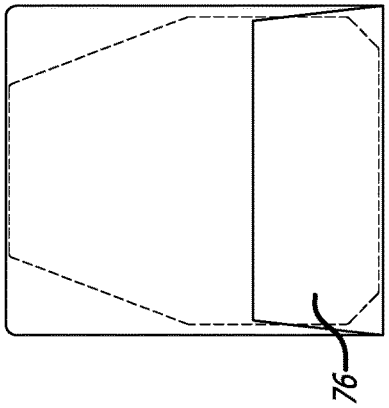
Figure 7A:
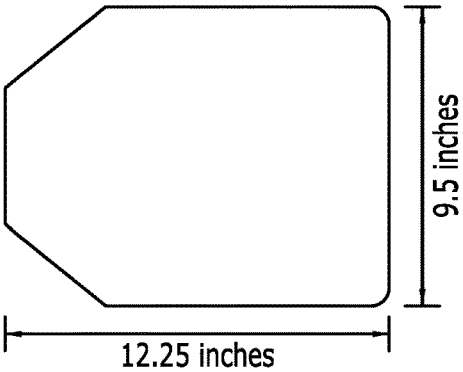
FIGS. 7A/7B, 8A/8B and 9A/9B are elevational views of different ballistic plate and sleeve combinations.
Figure 7B:
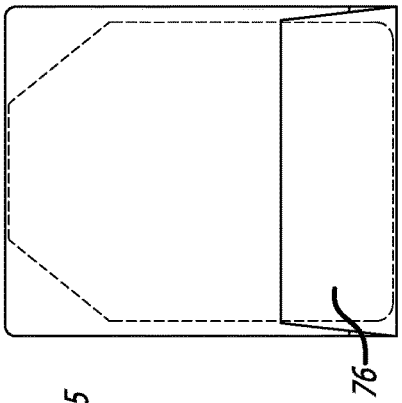

FIGS. 7A/7B, 8A/8B and 9A/9B are elevational views of different ballistic plate and sleeve 74 combinations that can be formed for use in the modified protective vests disclosed herein. As seen in FIGS. 7A, 8A and 9A, ballistic plates come in different sizes and shapes. When inserted within the sleeve 74, the closure flap 76 can be mated in different ways with the hook and loop strip 77 as seen in FIGS. 7B, 8B and 9B.

The plate and sleeve subassembly 32 may be easily expelled from within the chassis 40. First of all, the wearer need only yank on the lower emergency release handle 34 to break the safety ties 54 and pull the subassembly 32 of the chassis 40. Additionally, the sleeve 74 of the subassembly 32 may be made of a woven or non-woven fabric such as an extremely low friction polymeric material which facilitates removal of the subassembly from within the chassis 40. One suitable material is an ultrahigh molecular weight polyethylene (UHMWPE) woven composite. One example is sold under the tradename Dyneema, and has an exceptionally slick surface that minimizes friction when removing the subassembly 32 from sometimes highly compressed protective vests. Another good option is Teflon, or polytetrafluoroethylene. Of course, various flexible materials such as thin/flexible films or laminates may also be suitable.

Figure 10A:
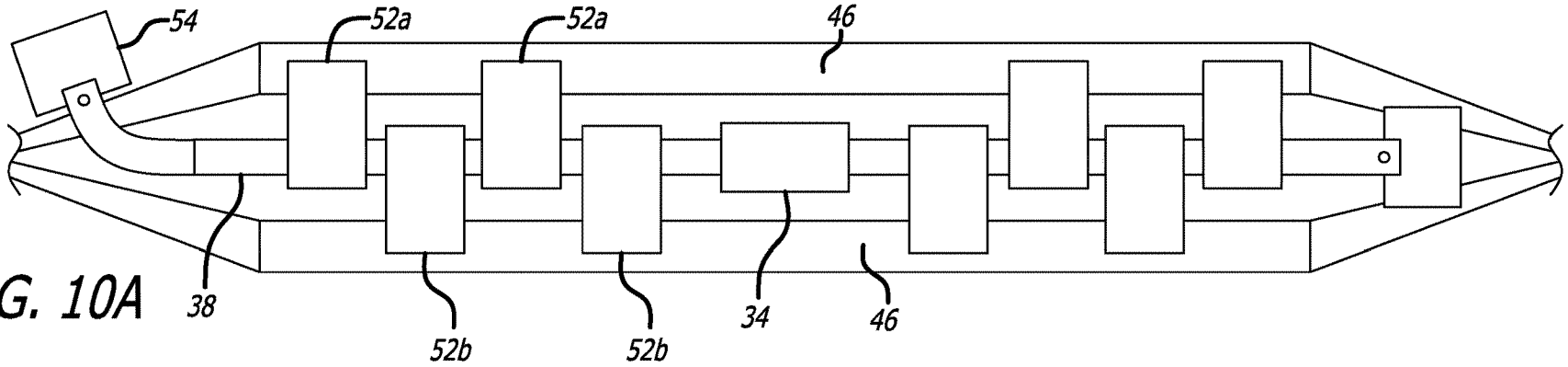
FIGS. 10A and 10B are two different lower end views of the assembled outer chassis and inner ballistic plate and sleeve showing a retention mechanism having a release cable passed through a plurality of retention loops.

FIG. 10A is a lower end view of the assembled outer chassis 40 and inner ballistic plate and sleeve showing the retention mechanism having the release cable 38 passed through a plurality of the retention loops 52*a*, 52*b*, which may be flexible fabric or more rigid plastic. This illustrates the passage of the release cable 38 through alternating loops 52 on opposite lower edges 46.

Figure 10B:
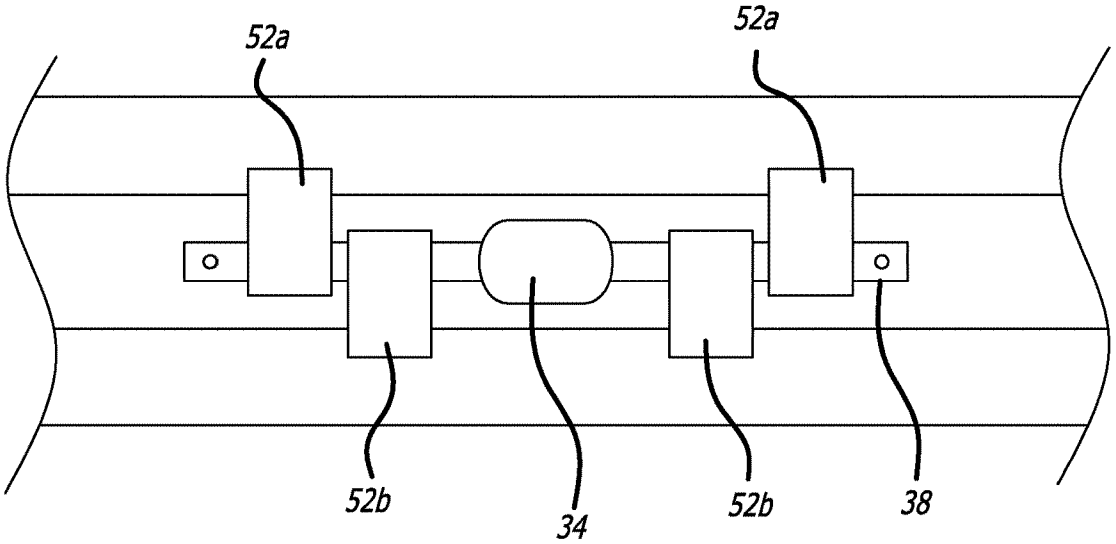

FIG. 10B is a lower end view of an assembled outer chassis 40 and inner ballistic plate and sleeve showing an alternative retention mechanism. Namely, instead of 4 or more nylon webbing loops on each side of the release handle 34 as in FIG. 10A, the loop arrangement can be constructed in any form to hold the release cable. For instance, a reduced number of loops 52*a*, 52*b* such as 2 on each side as shown achieves similar performance and facilitates production and rigging. The cable 38 is shown with a reduced length, though it may be the same length as in FIG. 10A with greater spacing between loops 52*a*, 52*b*.

Figure 11A:
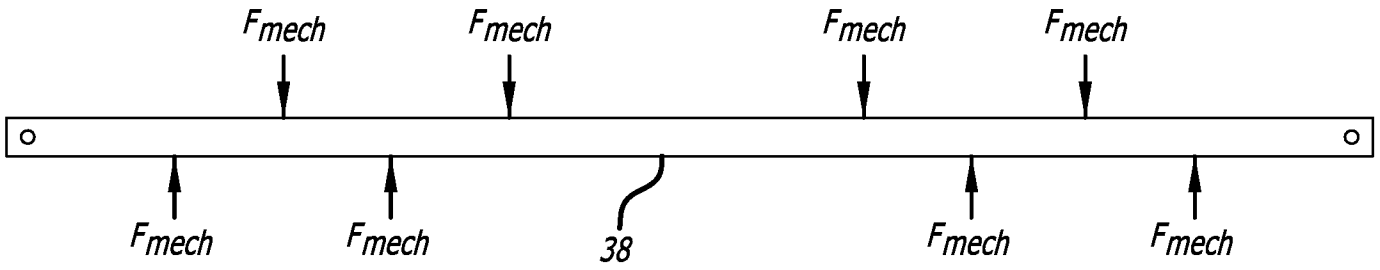
FIG. 11A is a schematic diagram indicating the mechanical forces imparted to the retention mechanism in use.

FIG. 11A is a schematic diagram indicating the mechanical forces imparted to the retention mechanism in use. That is, the weight of the plate and sleeve subassembly 32 imparts alternating mechanical forces on the release cable 38 which tend to balance one another out, thus putting minimal stress on the safety ties 54 (or other retention device) at each end. More particularly, the downward forces imparted by the weight of the subassembly 32 on the alternating retention loops 52*a*, 52*b* translates into both downward and front-to-rear oriented forces on the loops, which strain the release cable 38 in a serpentine manner. This helps retain the release cable 38 in place and reduces the magnitude of lateral force that reaches the safety ties 54. Consequently, the safety ties 54 can be made relatively lightweight to make breaking them easier, while they are still sufficiently strong to maintain their integrity for extended periods. The safety ties 54 may be made of plastic, such as materials compatible with the anticipated environmental contaminants (nylon or ethylene chlorotrifluoroethylene (ECTFE) beaded safety ties). In the illustrated embodiment there are four retention loops 52*a*, 52*b* on opposite lower edges 46, two on each side, which is believed to be a minimum suitable number to provide adequate holding force.

Figure 11B:
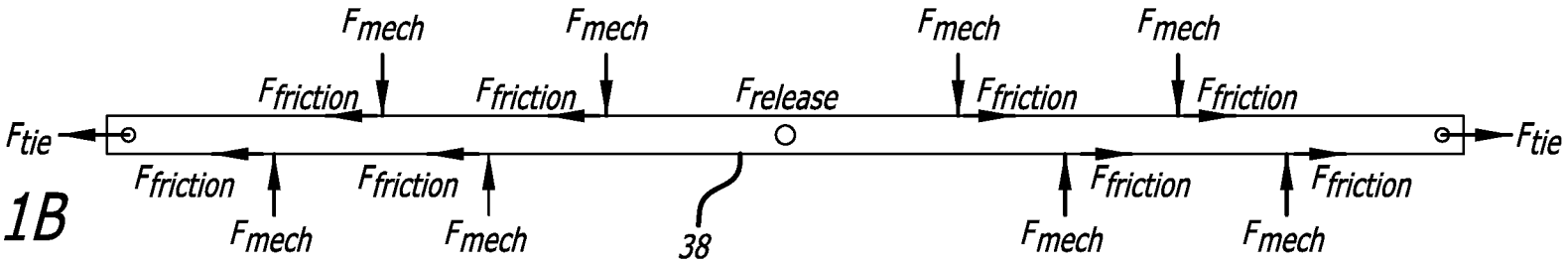
FIG. 11B is a diagram indicating forces acting on a release cable of the retention mechanism during actuation.

FIG. 11B is a diagram indicating forces acting on the release cable 38 of the retention mechanism during actuation. Namely, the only forces acting laterally are the reaction forces $F_{tie}$ from pulling on the safety ties 54, as well as minimal frictional forces $F_{friction}$ imparted by the retention loops 52*a*, 52*b* on the cable 38. This reduces the amount of force needed to pull the release cable 38 from within the retention mechanism 50, thus releasing the plate and sleeve subassembly 32 to be pulled free or drop from the chassis 40. Moreover, the release cable 38 may be made of polytetrafluoroethylene (PTFE or Teflon) which has low friction, is capable of withstanding large surface normal forces, has a wide service temperature range, does not embrittle or age, and is flame resistant, making it an excellent candidate for naval aviation environments. The release cable 38 may also be made of any polymer or fabric, yarn, rope material. An alternative to a round cross-section construction is a 1 inch nylon strap for the release cable 38.

Figure 12:
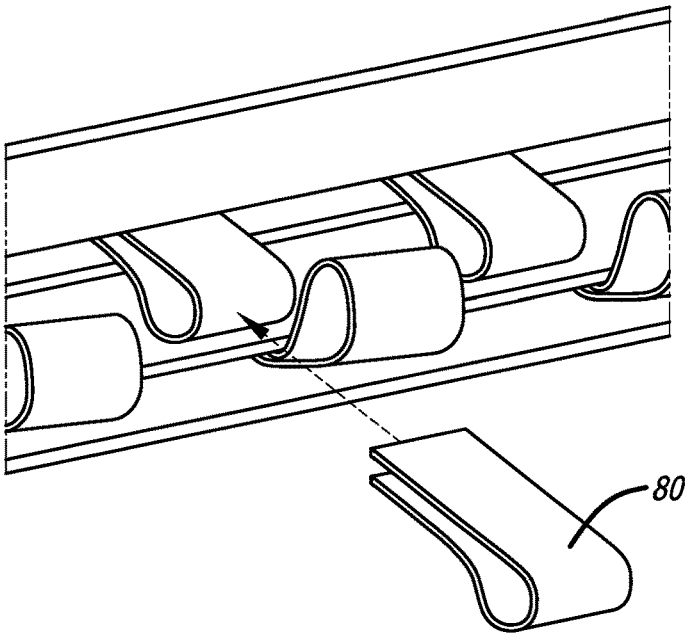
FIG. 12 is a perspective view of a lower end of an outer chassis and one construction of retention loops.

FIG. 12 is a perspective view of a lower end of an outer chassis and one construction of retention loops. Specifically, the loops may be formed of separate strips of material that are folded into a U-shape and the two aligned free ends then secured with stitches to the chassis lower end.

Figure 13A:
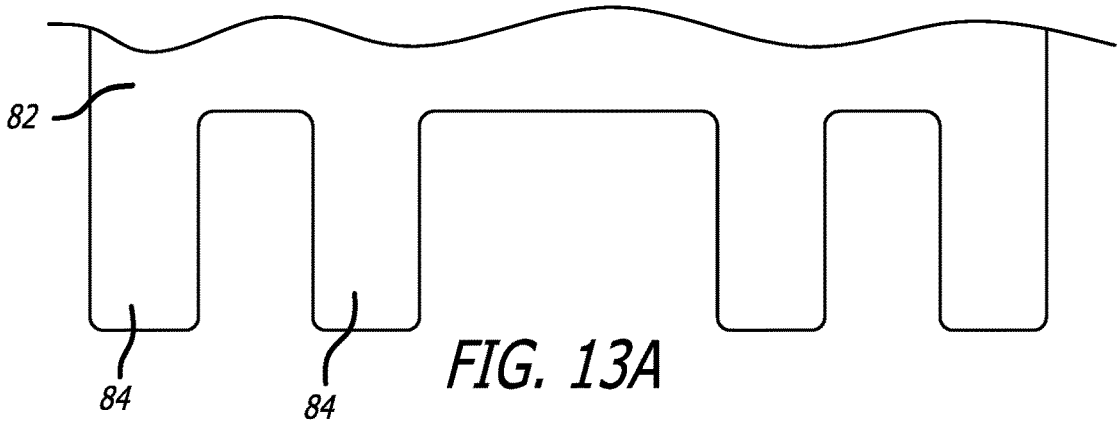
FIG. 13A is a plan view of a lower end of an outer chassis and an alternative construction for forming retention loops.
Figure 13B:
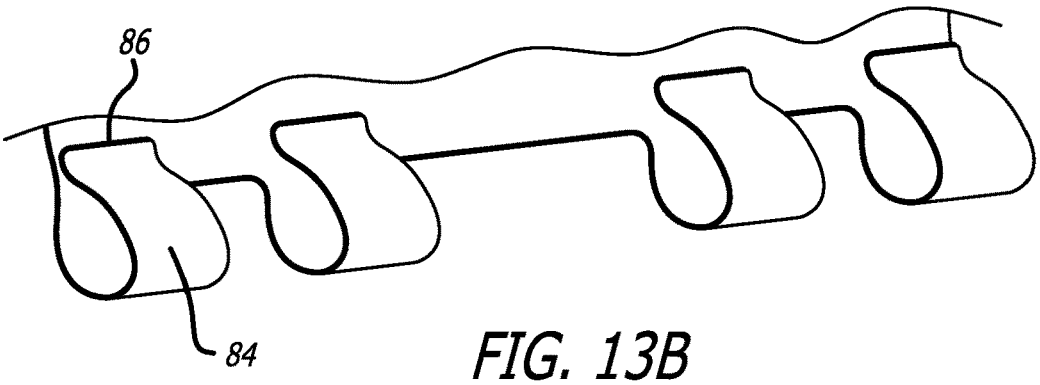
FIG. 13B is a perspective view of the lower end of the outer chassis with formed retention loops.

A simplified configuration is seen in FIGS. 13A, where a lower edge of a panel 82 of the outer chassis is crenelated, or formed with a plurality of elongated tabs 84. FIG. 13B is a perspective view of the lower end of the panel 82 after the tabs 84 are folded up on themselves and stitched at 86 to form retention loops. This reduces the number of parts required and simplifies the assembly process. Moreover, the tabs 84 may be laser-cut on the lower edge of the panel 82 for accuracy, speed and to seal the tab edges with heat.

Figure 14:
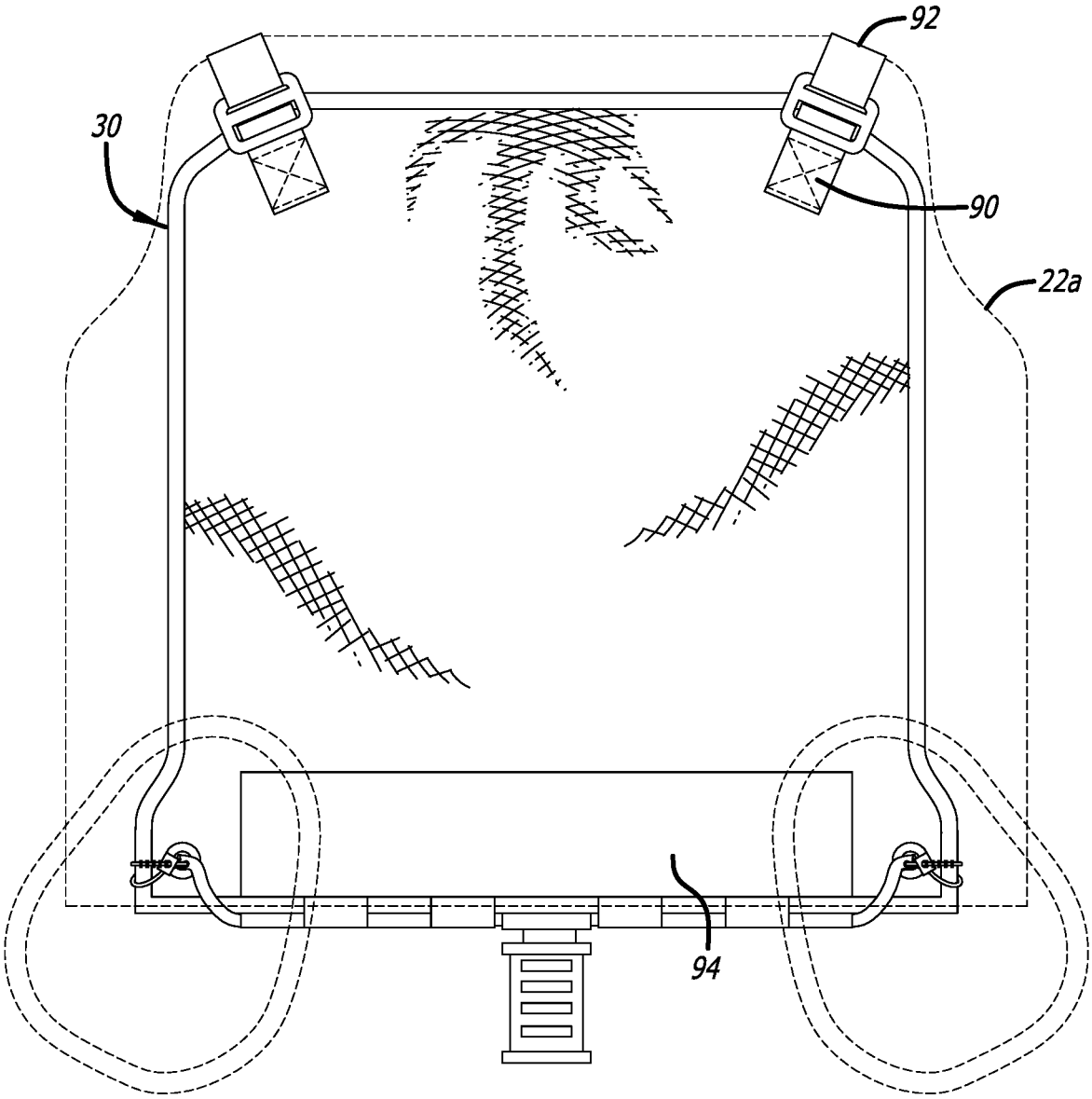
FIG. 14 is an elevational view illustrating one way to mount a quick-release ballistic plate assembly to a chest panel and/or back panel of a protective vest shown in phantom.

FIG. 14 is an elevational view illustrating one way to mount a quick-release ballistic plate assembly 30 to a chest panel 22*a* (or back panel 22*b*) of a protective vest shown in phantom. The ballistic plate assembly 30 has a pair of buckle straps 90 or other such interlocking load bearing elements secured thereto at upper lateral corners. Mating buckle straps 92 are added to the rear face of the chest panel 22*a* near upper lateral corners as well. These can easily be added at the OEM level or retrofitted to existing protective vests with stitching. The mating buckle straps 90, 92 support the majority of the weight of the assembly 30 including the ballistic plate therein. A lower hook and loop strip 94 on a front face of the assembly 30 engages a mating hook and loop strip (96 in FIG. 19) on the rear face of chest panel 22*a*. Again, such a mating hook and loop strip is easily stitched to the chest panel 22*a*. Thus, simply adding two buckle straps 92 and a strip of hook and loop fastener to each chest panel 22*a*, 22*b* retrofits the protective vest 20 to receive front and rear quick-release ballistic plate assemblies 30.

Figure 15B:
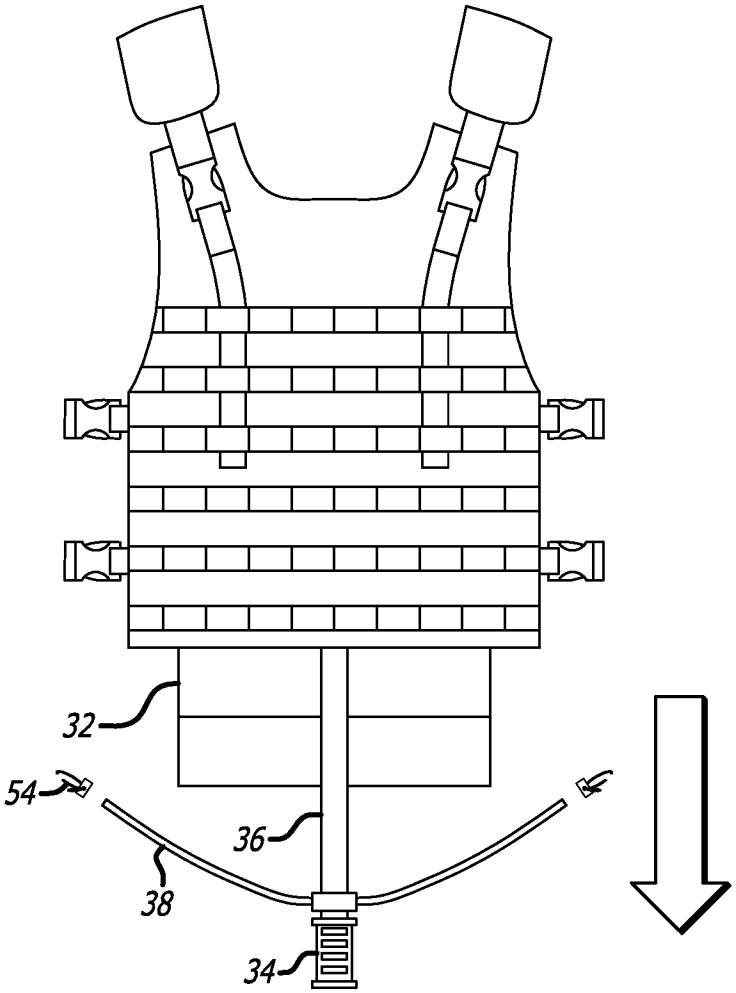
FIG. 15B shows the actuation of the system, releasing the ballistic plate and sleeve subassembly from the vest.
Figure 15A:
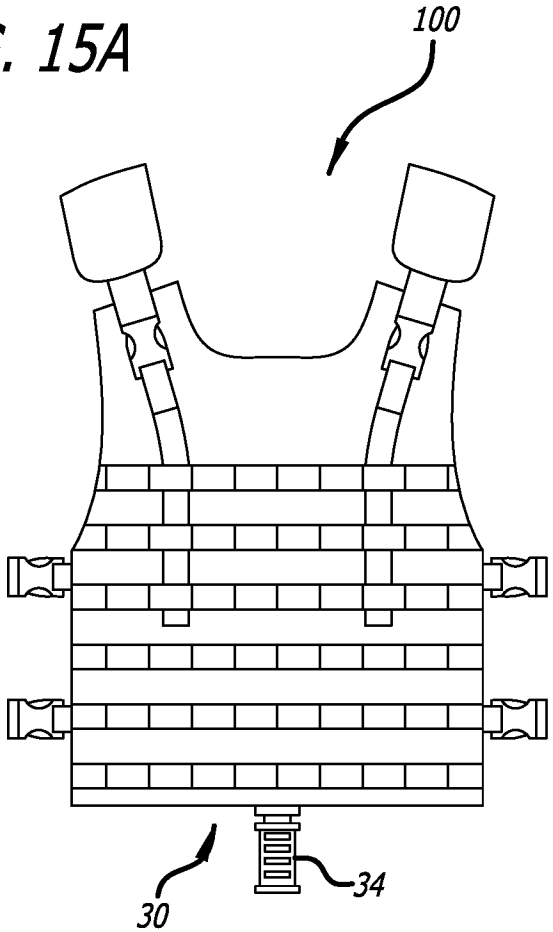
FIG. 15A is an elevational view of an alternative protective vest outfitted with a quick-release ballistic plate assembly.

FIG. 15A is a perspective view of an alternative modified protective vest 100 outfitted with a quick-release ballistic plate assembly 30 of the present application. This type of vest is often known in the industry as PRU-70. FIG. 15B shows the ballistic plate and sleeve subassembly 32 being separated from the vest in the same manner as above; by pulling down on the emergency release handle 34 to break the safety ties 54.

Figure 16:
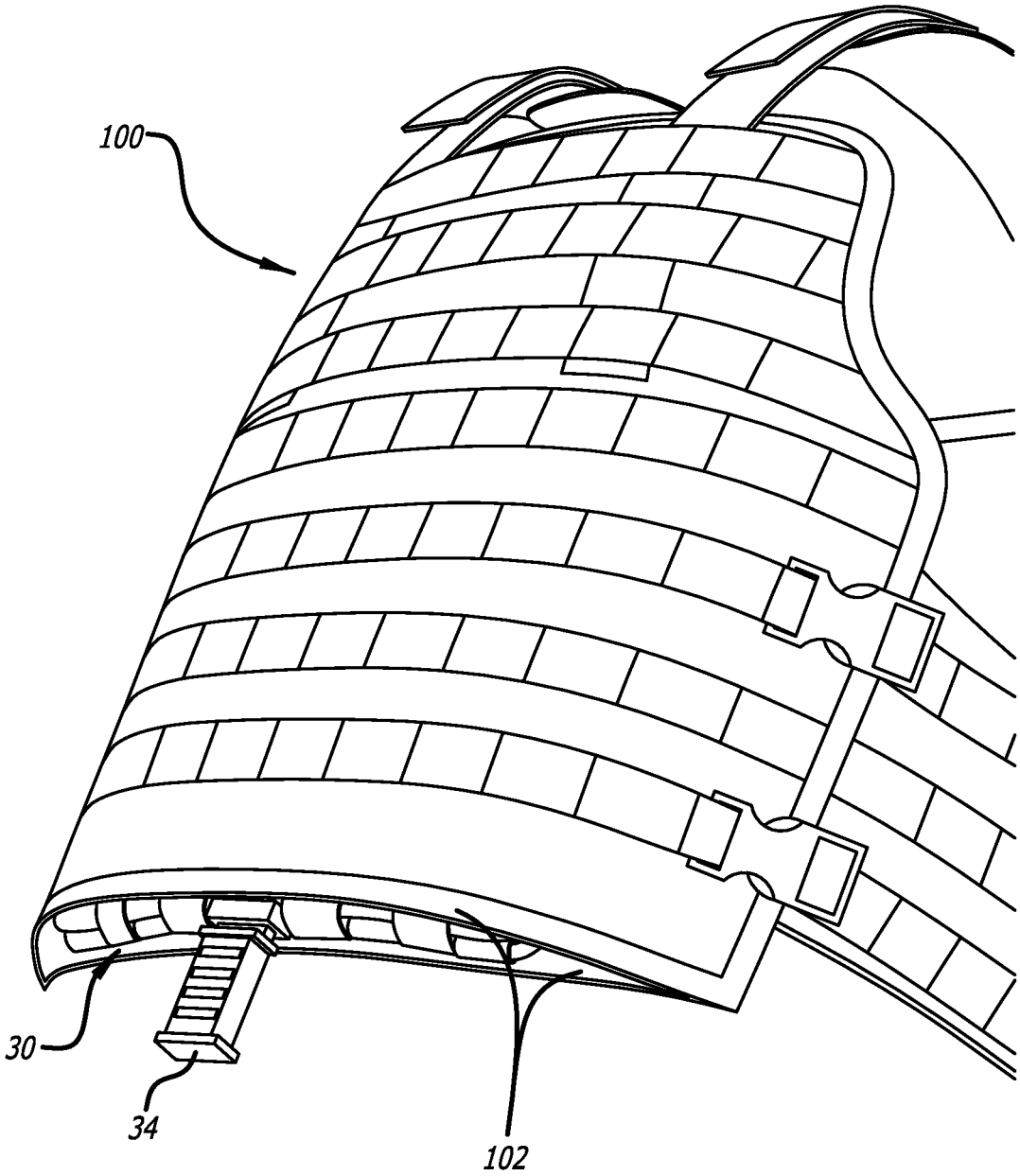
FIG. 16 is perspective view looking upward at the alternative protective vest of FIG. 15A showing one way to retrofit a quick release ballistic plate assembly therewith.

FIG. 16 is perspective view from a lower perspective of the alternative protective vest 100 of FIG. 15A showing one way to retrofit a quick release ballistic plate assembly 30 therewith. Namely, this type of vest includes an interior cavity opening downward and bordered by two lower edges 102. The assembly 30 is inserted upward into the cavity and held therein by buckles, fasteners, or the like.

Figure 16A:
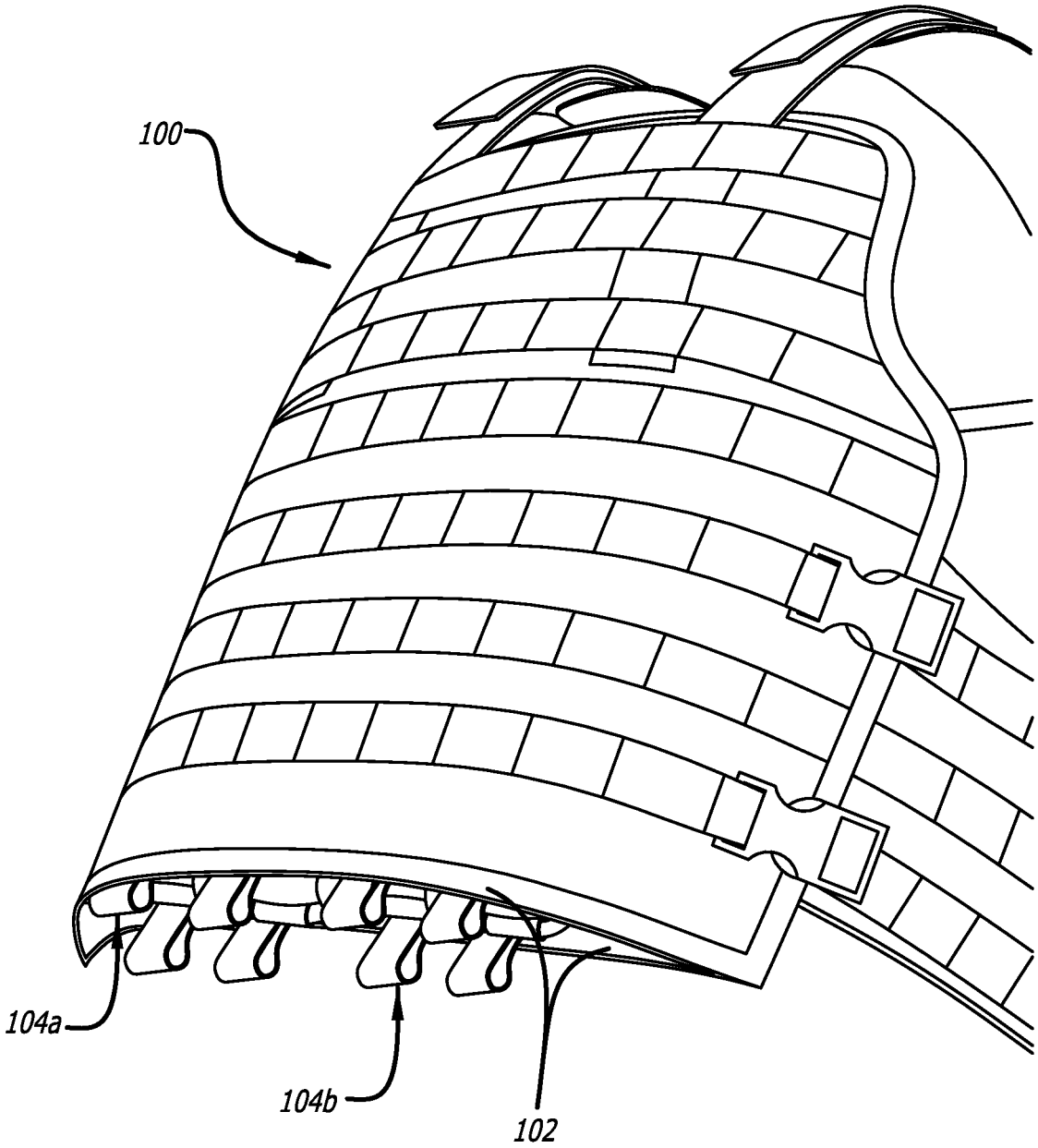
FIG. 16A is perspective view looking upward a modified protective vest similar to that in FIG. 15A showing another way to retrofit a quick release ballistic plate assembly therewith.

FIG. 16A is perspective view looking upward a modified protective vest similar to that in FIG. 15A showing another way to retrofit a quick release ballistic plate assembly therewith. Again, this type of vest includes an interior cavity opening downward and bordered by two lower edges 102. The cavity often holds a ballistic hard plate therein with the lower edges 102 sewn together to enclose the plate. However, before the lower edges 102 are sewn during manufacture, retention loops 104*a*, 104*b* as described herein may be fastened to the edges. Instead of inserting an entire assembly 30 upward into the cavity to be held therein by buckles, fasteners, or the like, just a plate/sleeve subassembly 32 is inserted. That is, there is no chassis 40. With reference to FIG. 3, the emergency release handle 34 and pull strap 36 are again attached (e.g., sewn) to the exterior of the plate and sleeve subassembly 32. However, since the loops 104*a*, 104*b* are now on the vest edges 102, there is no need for the chassis 40. The release cable 38 extending from the release handle 34 is then secured in a breakable way to the vest itself. This arrangement can be constructed during manufacture to create an OEM product, or, existing vests may be retrofitted by cutting the seam at the lower edges 102, removing the ballistic plate, and adding the loops 104*a*, 104*b*. Then the plate and sleeve subassembly 32 is inserted and the cable 38 secured to its breakable anchors.

Figure 17A:
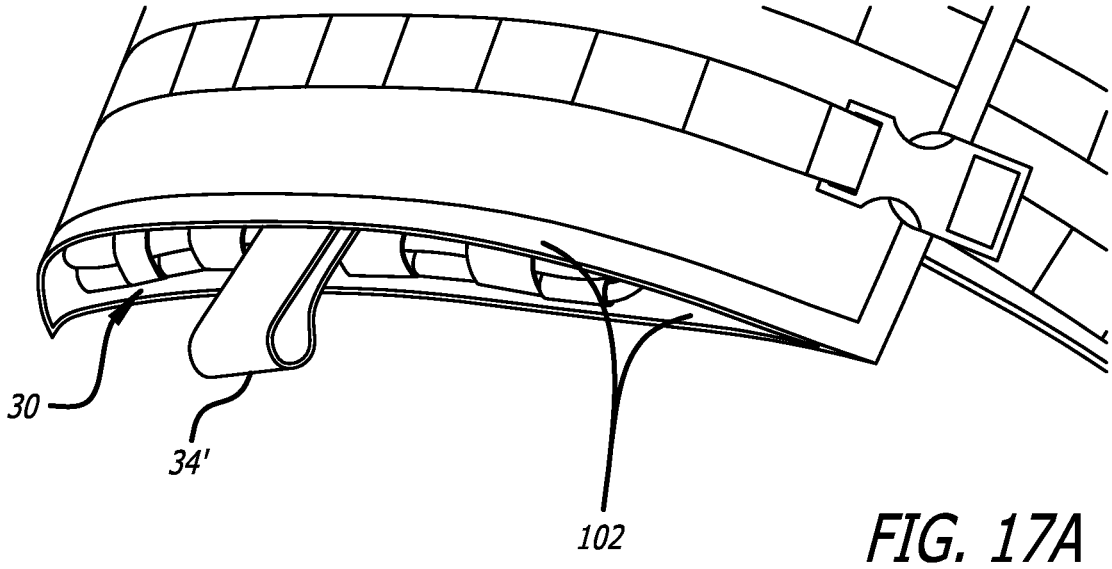
FIGS. 17A and 17B are two different perspective views of a lower end of the quick-release ballistic plate assembly of FIG. 15A showing alternative release handles.
Figure 17B:
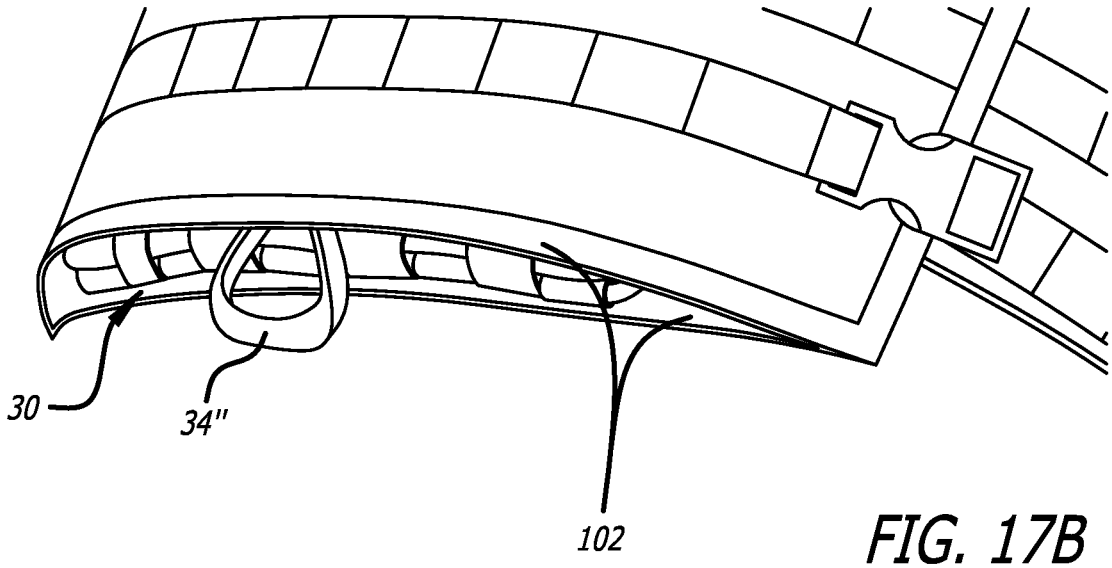

FIGS. 17A and 17B are two different perspective views of a lower end of the quick-release ballistic plate assembly 30 of FIG. 15A showing alternative pull straps. Instead of a plastic release handle 34, FIG. 17A shows a fabric loop 34', which can be formed by sewing a separate piece to the lower end or extending the lower end in a tab and folding and sewing it to itself, as seen in FIG. 13B. FIG. 17B shows another handle 34" which is ergonomically shaped or molded for ease of grasping with one or two fingers. Instead of the loop 34' which opens to the sides, the shaped handle 34" has an opening oriented to the front (or rear if the plate is on the rear panel).

Figure 18:
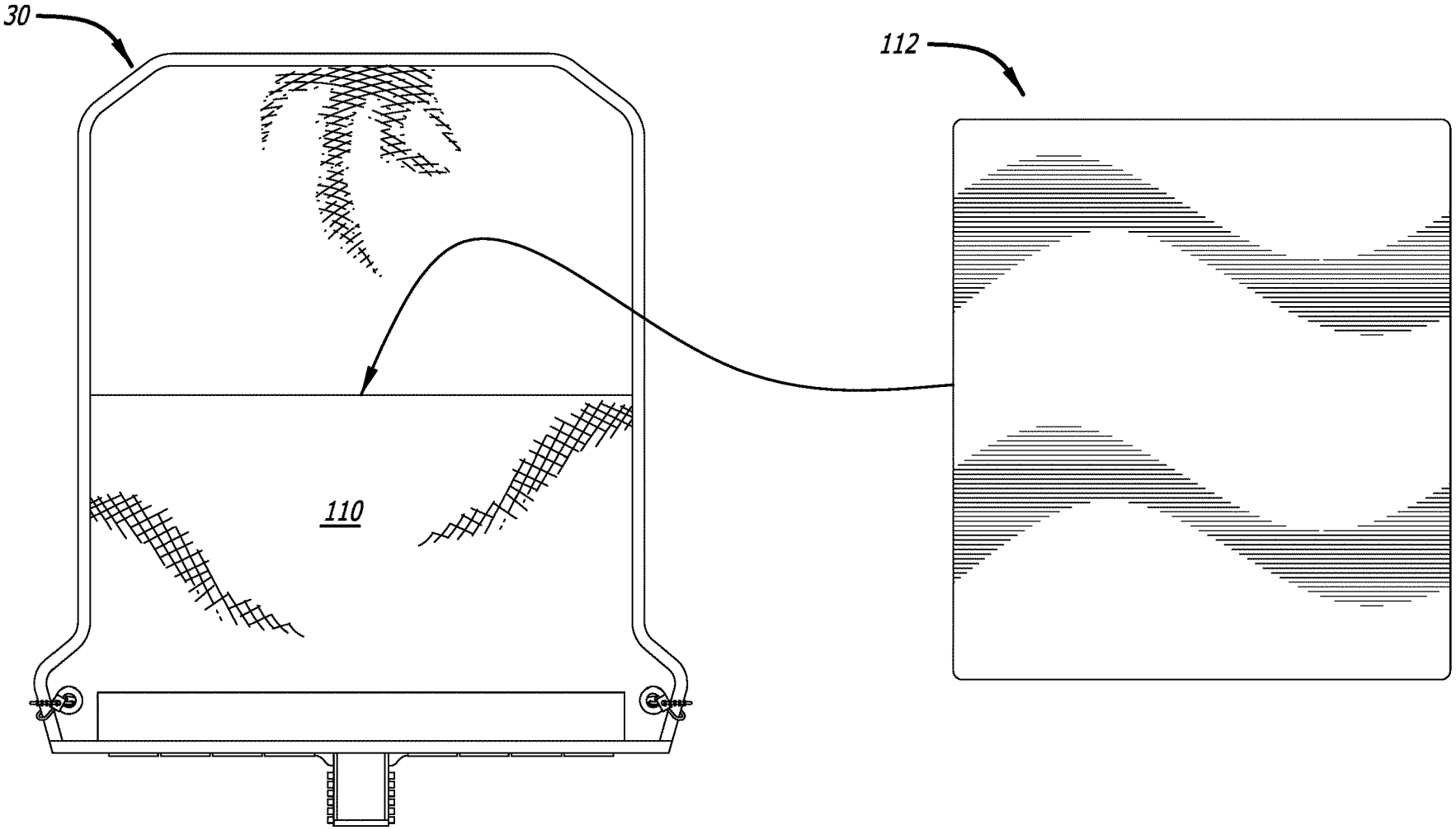
FIG. 18 is an elevational view of the quick-release ballistic plate assembly showing addition of a soft armor protective plate.

FIG. 18 is an elevational view of a rear face of the quick-release ballistic plate assembly 30. The assembly 30 may be provided with a larger pocket 110 into which a soft armor protective plate 112 can be inserted and secured with overlapping panels. Soft plates 112 made of tough material such as Kevlar are often used when a rigid ballistic plate is not necessary or in conjunction to further enhance ballistic protection.

Figure 19:
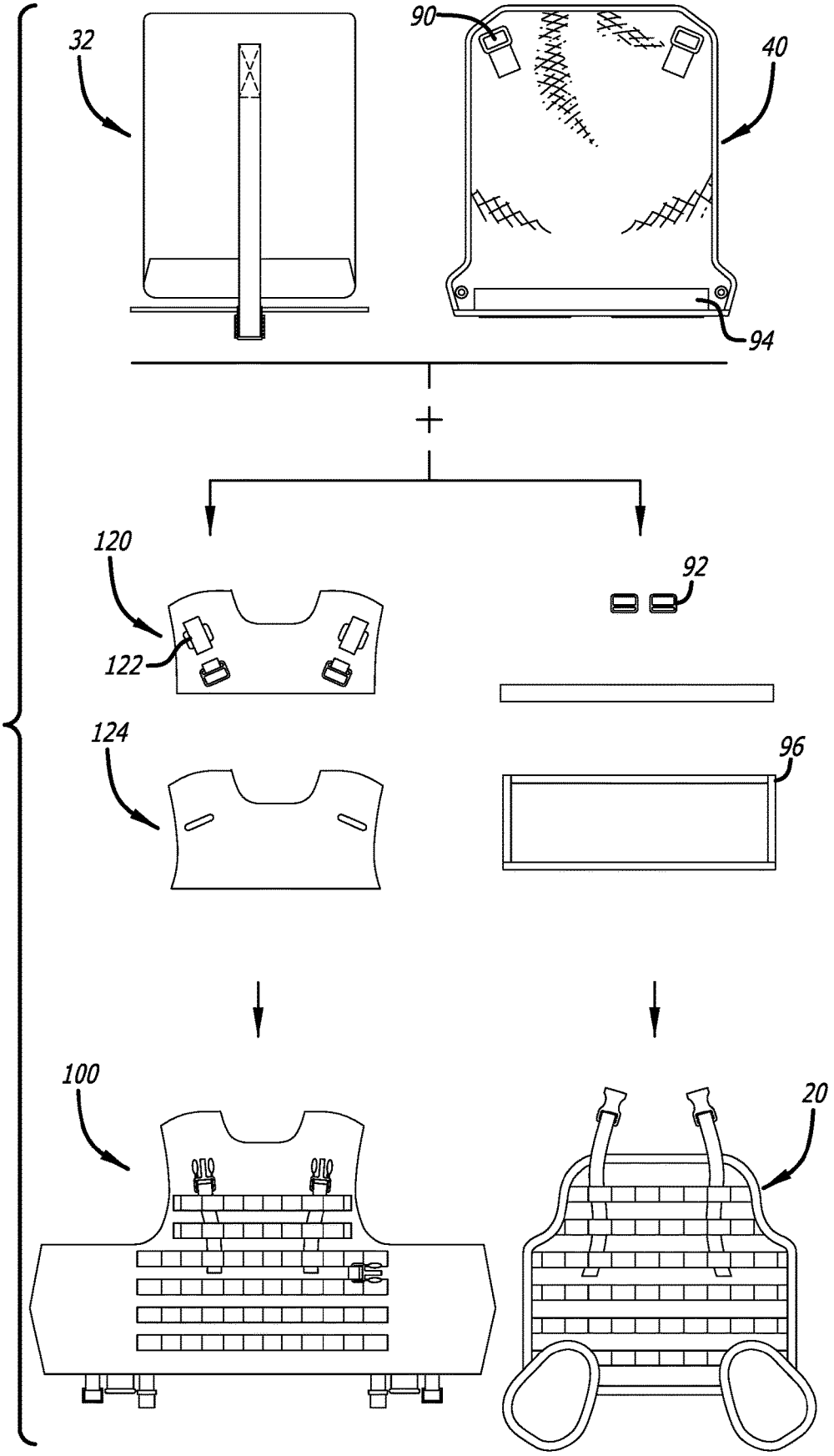
FIG. 19 is a schematic diagram of the retrofitting process for two exemplary protective vests.

FIG. 19 is a schematic diagram of the retrofitting process for two exemplary types of protective vests 20, 100. The combination of the plate/sleeve subassembly 32 into the chassis 40 to form the quick-release ballistic plate assembly 30 is the same, regardless of vest type. From there, installation of the hook tape, anchors and replacement panel (if needed) changes depending on the vest type. Templates are utilized to guide retrofit fabrication. An anchor placement template 120 locates the mating buckles/straps 122 within the cavity that are configured to mate with the buckles 90 on the exterior of the chassis 40. An outer stitching position template 124 is then held in stable position on the exterior of the vest 100 to guide the technician as to where to sew the buckles/straps 122 within the cavity. The outer stitching position template 124 can then be removed, as it may be paper, while the anchor placement template 120 may remain in place or be ripped out as well, as it does not impede attachment of the ballistic plate assembly 30.

Figure 20:
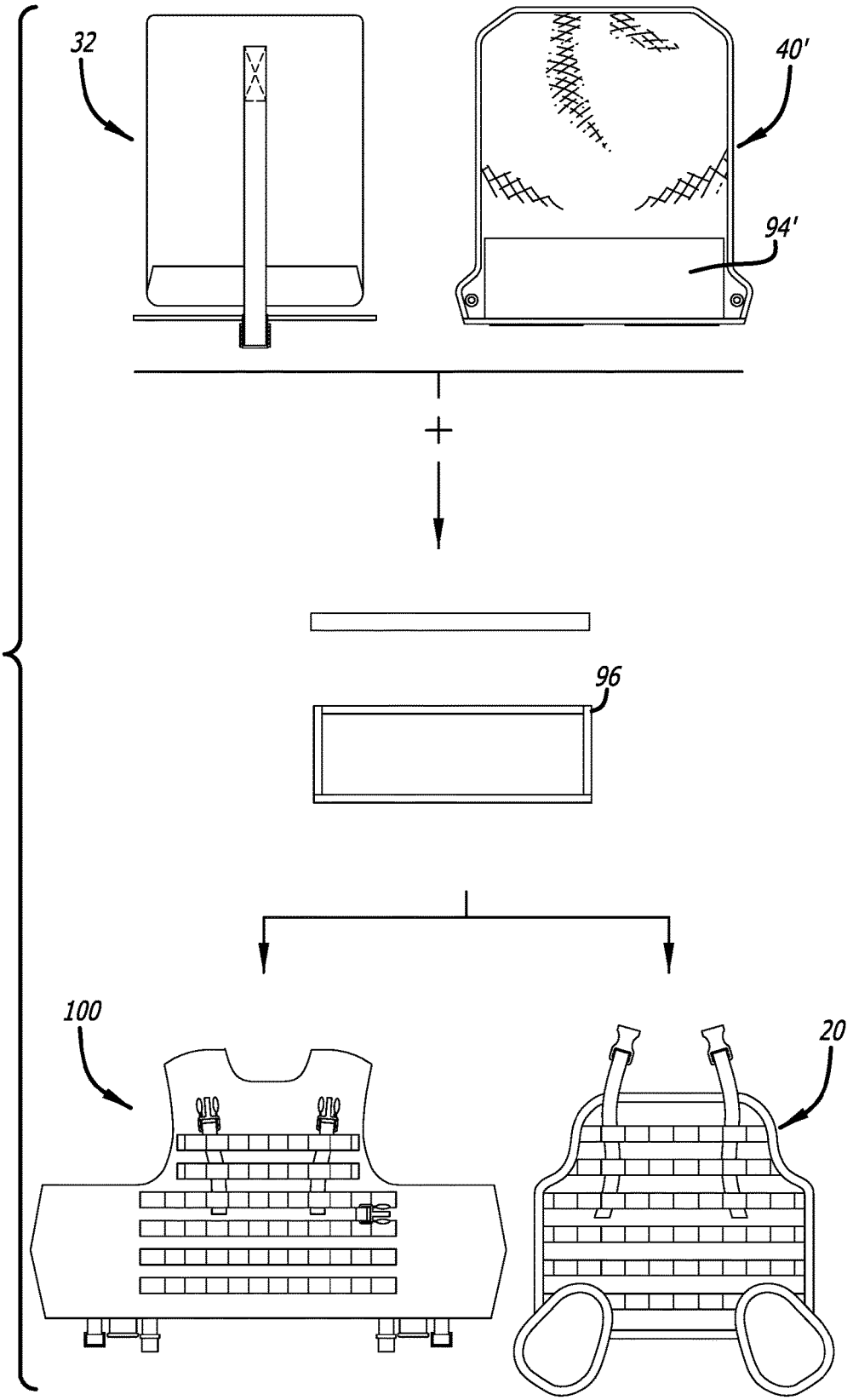
FIG. 20 is a schematic diagram of an alternative retrofitting process for two exemplary protective vests.

FIG. 20 is a schematic diagram of an alternative retrofitting process for two exemplary protective vests. First, an alternative chassis 40' has stronger and wider Velcro fastener panels 94' at a lower end on one or both faces which attach to opposite hook and loop fastening panel(s) within either or both the front chest or rear back panel of the outer protective vest 20. This stronger attachment enables removal of the upper chassis buckles 90, 92 that were seen in FIG. 19.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. An apparatus comprising a quick-release ballistic plate assembly for a protective vest, comprising:

an outer chassis having at least a pair of flexible panels connected together at outer top and side edges thereof, with aligned lower edges unconnected to define an open lower mouth leading upward to an inner cavity between the panels, the outer chassis having attachment structure thereon for mounting to the protective vest;

a ballistic plate and sleeve subassembly having a rigid ballistic plate held within a flat sleeve made of a flexible material, the subassembly being sized to fit through the lower mouth of the outer chassis into the cavity, and the subassembly having an emergency release handle at a lower end thereof; and a subassembly retention mechanism having a release cable fixed to the emergency release handle and passed laterally through a plurality of retention loops affixed at or near lower edges of the outer chassis, wherein the release cable through the retention loops has sufficient strength to retain the subassembly in place within the cavity until pulled free of the retention loops by pulling on the emergency release handle.

2. The apparatus of claim 1, wherein the release cable is made of polytetrafluoroethylene.

3. The apparatus of claim 1, wherein the sleeve has a hook and loop closure at a lower end with a flap configured to mate with a strip on an exterior panel, and wherein the flap has a larger hook and loop dimension than the strip to enable the flap to mate with the strip in a variety of positions to change an overall outer dimension of the sleeve and contain differently-sized ballistic plates.

4. The apparatus of claim 1, wherein the outer chassis further includes an external pocket and a soft armor protective plate inserted and secured therein.

5. The apparatus of claim 1, wherein there are at least two retention loops at or near each lower edge of the outer chassis.

6. The apparatus of claim 1, wherein the attachment structure on the outer chassis for mounting to the protective vest comprises hook and loop patches at least at lower lateral corners configured to engage mating structure provided on the protective vest.

7. The apparatus of claim 1, wherein the attachment structure on the outer chassis for mounting to the protective vest comprises interlocking load bearing elements at least at upper lateral corners, each configured to engage mating structure provided on the protective vest.

8. The apparatus of claim 1, wherein the outer chassis including the retention loops is made of nylon.

9. The apparatus of claim 1 further comprising the protective vest.

10. A method of retrofitting a protective vest, including:

removing any panels used to contain a rigid plate from a chest or back panel of a protective vest;

adding mating structure to the chest or back panel, the mating structure configured to engage the attachment structure on the outer chassis of the assembly of claim 1; and attaching the assembly of claim 1 to the chest or back panel such that the emergency release handle depends downward lower than a lower edge of the chest or back panel.

11. The method of claim 10 wherein the chest or back panel of the protective vest has a downwardly-opening inner cavity within which the assembly of claim 1 is inserted.

12. An apparatus comprising a quick-release ballistic plate assembly for a protective vest, comprising:

a protective vest having at least a pair of flexible fabric panels connected together with aligned lower edges unconnected to define an open lower mouth leading upward to an inner cavity between the panels, the lower mouth being positioned adjacent a lower extent of a chest or back panel of the protective vest;

a ballistic plate and sleeve subassembly having a rigid ballistic plate held within a flat sleeve made of flexible material, the subassembly being sized to fit through the lower mouth into the cavity, and being held therein by a subassembly retention mechanism, wherein the sleeve has a hook and loop closure at a lower end with a flap configured to mate with a strip on an exterior panel, and wherein the flap has a larger hook and loop dimension than the strip to enable the flap to mate with the strip in a variety of positions to change an overall outer dimension of the sleeve and contain differently-sized ballistic plates;

the subassembly having an emergency release handle at a lower end thereof that depends downward below the lower extent of the chest or back panel of the protective vest, and the subassembly retention mechanism having sufficient strength to retain the subassembly in place within the cavity until the emergency release handle is pulled.

13. The apparatus of claim 12 wherein the subassembly retention mechanism includes a release cable fixed to the emergency release handle and passed through a plurality of retention loops at or near the aligned lower edges, wherein the release cable through the retention loops has sufficient strength to retain the subassembly in place within the cavity until pulled free of the retention loops by pulling on the emergency release handle.

14. The apparatus of claim 13 wherein the release cable is affixed to the protective vest by breakable anchors, and wherein the breakable anchors have sufficient strength to retain the release cable in place while being configured to break from manual pulling on the emergency release handle.

15. The apparatus of claim 13 wherein the release cable is made of polytetrafluoroethylene.

16. The apparatus of claim 12 wherein there are at least two retention loops at or near each lower edge of the protective vest.

17. The apparatus of claim 12, further including an outer chassis having the fabric panels, lower edges and open lower mouth and defining the inner cavity, the outer chassis being mounted within a pocket in the protective vest, and wherein the subassembly retention mechanism retains the subassembly in place within the cavity of the outer chassis.

18. The apparatus of claim 17 wherein the outer chassis further includes an external pocket and a soft armor protective plate inserted and secured therein.

19. The apparatus of claim 17 wherein the outer chassis comprises interlocking load bearing elements for mounting to mating interlocking load bearing elements within the pocket of the protective vest.

20. An apparatus comprising a quick-release ballistic plate assembly for a protective vest, comprising:

a protective vest having at least a pair of flexible fabric panels connected together with aligned lower edges unconnected to define an open lower mouth leading upward to an inner cavity between the panels, the lower mouth being positioned adjacent a lower extent of a chest or back panel of the protective vest;

a ballistic plate and sleeve subassembly having a rigid ballistic plate held within a flat sleeve made of flexible material, the subassembly being sized to fit through the lower mouth into the cavity, and being held therein by a subassembly retention mechanism;

the subassembly having an emergency release handle at a lower end thereof that depends downward below the lower extent of the chest or back panel of the protective vest, and the subassembly retention mechanism having sufficient strength to retain the subassembly in place within the cavity until the emergency release handle is pulled, and wherein the subassembly retention mechanism includes a release cable fixed to the emergency release handle and passed through a plurality of retention loops at or near the aligned lower edges, wherein the release cable through the retention loops has sufficient strength to retain the subassembly in place within the cavity until pulled free of the retention loops by pulling on the emergency release handle.

21. An apparatus comprising a quick-release ballistic plate assembly for a protective vest, comprising:

a protective vest having at least a pair of flexible fabric panels connected together with aligned lower edges unconnected to define an open lower mouth leading upward to an inner cavity between the fabric panels, the lower mouth being positioned adjacent a lower extent of a chest or back panel of the protective vest;

a ballistic plate and sleeve subassembly having a rigid ballistic plate held within a flat sleeve made of flexible material, the subassembly being sized to fit through the lower mouth into the cavity, and being held therein by a subassembly retention mechanism;

the subassembly having an emergency release handle at a lower end thereof that depends downward below the lower extent of the chest or back panel of the protective vest, and the subassembly retention mechanism having sufficient strength to retain the subassembly in place within the cavity until the emergency release handle is pulled, and further including an outer chassis having the fabric panels, lower edges and open lower mouth and defining the inner cavity, the outer chassis being mounted within a pocket in the protective vest, and wherein the subassembly retention mechanism retains the subassembly in place within the cavity of the outer chassis.

22. The apparatus of claim 21 wherein the outer chassis further includes an external pocket and a soft armor protective plate inserted and secured therein.

23. The apparatus of claim 21 wherein the outer chassis comprises interlocking load bearing elements for mounting to mating interlocking load bearing elements within the pocket of the protective vest.

* * * * *